US007712860B2

(12) United States Patent
Edamura et al.

(10) Patent No.: US 7,712,860 B2
(45) Date of Patent: May 11, 2010

(54) INK JET PRINTING APPARATUS AND INK JET PRINTING METHOD

(75) Inventors: Tetsuya Edamura, Kawasaki (JP); Kiichiro Takahashi, Yokohama (JP); Minoru Teshigawara, Yokahama (JP); Akiko Maru, Tokyo (JP); Yoshiaki Murayama, Tokyo (JP); Takatoshi Nakano, Tokyo (JP); Hiroshi Taira, Chofu (JP)

(73) Assignee: Canon Kabushiki Kaisha, Tokyo (JP)

( * ) Notice: Subject to any disclaimer, the term of this patent is extended or adjusted under 35 U.S.C. 154(b) by 82 days.

(21) Appl. No.: 12/188,770

(22) Filed: Aug. 8, 2008

(65) Prior Publication Data

US 2009/0046119 A1 Feb. 19, 2009

(30) Foreign Application Priority Data

Aug. 14, 2007 (JP) ..... 2007-211474

(51) Int. Cl.
*B41J 2/205* (2006.01)

(52) U.S. Cl. ..... 347/15; 347/43

(58) Field of Classification Search ..... 347/15, 347/41, 43

See application file for complete search history.

(56) References Cited

U.S. PATENT DOCUMENTS 6,206,502 B1 3/2001 Kato et al.
6,250,737 B1 * 6/2001 Matsubara et al. ..... 347/40
6,601,939 B2 8/2003 Fujita et al.
2007/0019031 A1 1/2007 Murayama et al.

FOREIGN PATENT DOCUMENTS

JP 2000-108322 A 4/2000
JP 2007-38671 A 2/2007

* cited by examiner

*Primary Examiner*—Thinh H Nguyen
(74) *Attorney, Agent, or Firm*—Fitzpatrick, Cella, Harper & Scinto

(57) ABSTRACT

An ink jet printing apparatus and an ink jet printing method are provided which are capable of minimizing image impairments caused by a bias of satellite positions even when an odd-numbered-pass bidirectional multi-pass printing is performed. To this end, in an odd-numbered-pass bidirectional printing, a mask pattern, in which print permitted pixels and print non-permitted pixels are arranged such a way that a percentage of pixels in which predetermined two inks are permitted to be printed by scans in different directions is higher than a percentage of pixels in which the predetermined two inks are permitted to be printed by scans in the same directions, is used. This increases the probability of satellites of the two types of the inks printed in the same pixels being printed on both sides of main dots, thus allowing a uniform image to be produced even by an odd-numbered-pass bidirectional printing.

9 Claims, 23 Drawing Sheets

| | PATTERN A | PATTERN B | PATTERN C | PATTERN D | PATTERN E | PATTERN F |
|---|---|---|---|---|---|---|
| PATTERN A | 30.00% | 0.00% | 0.00% | 0.00% | 30.00% | 0.00% |
| PATTERN B | 0.00% | 40.00% | 0.00% | 10.00% | 0.00% | 30.00% |
| PATTERN C | 0.00% | 0.00% | 30.00% | 20.00% | 10.00% | 0.00% |
| PATTERN D | 0.00% | 10.00% | 20.00% | 30.00% | 0.00% | 0.00% |
| PATTERN E | 30.00% | 0.00% | 10.00% | 0.00% | 40.00% | 0.00% |
| PATTERN F | 0.00% | 30.00% | 0.00% | 0.00% | 0.00% | 30.00% |

FIG.17

| | PATTERN A | PATTERN B | PATTERN C | PATTERN D | PATTERN E | PATTERN F |
|---|---|---|---|---|---|---|
| PATTERN A | 29.17% | 0.00% | 0.00% | 0.00% | 29.17% | 0.00% |
| PATTERN B | 0.00% | 39.58% | 0.00% | 10.03% | 0.00% | 29.56% |
| PATTERN C | 0.00% | 0.00% | 31.25% | 21.09% | 10.16% | 0.00% |
| PATTERN D | 0.00% | 10.03% | 21.09% | 31.12% | 0.00% | 0.00% |
| PATTERN E | 29.17% | 0.00% | 10.16% | 0.00% | 39.32% | 0.00% |
| PATTERN F | 0.00% | 29.56% | 0.00% | 0.00% | 0.00% | 29.56% |

FIG.18

| | PATTERN A | PATTERN B | PATTERN C | PATTERN D | PATTERN E | PATTERN F |
|---|---|---|---|---|---|---|
| PATTERN A | 29.17% | 0.00% | 0.00% | 2.86% | 26.30% | 0.00% |
| PATTERN B | 0.00% | 39.58% | 0.00% | 5.08% | 6.26% | 31.25% |
| PATTERN C | 0.00% | 0.00% | 31.25% | 21.88% | 9.38% | 0.00% |
| PATTERN D | 2.86% | 5.08% | 21.88% | 29.82% | 0.00% | 0.00% |
| PATTERN E | 26.30% | 3.26% | 9.38% | 0.00% | 39.93% | 0.00% |
| PATTERN F | 0.00% | 31.25% | 0.00% | 0.00% | 0.00% | 31.25% |

FIG.22

INK JET PRINTING APPARATUS AND INK JET PRINTING METHOD

BACKGROUND OF THE INVENTION

1. Field of the Invention

The present invention relates to an ink jet printing apparatus and an ink jet printing method. More specifically it relates to an odd-numbered pass bidirectional printing method employed in serial type printing apparatus.

2. Description of the Related Art

In recent years, relatively inexpensive office automation devices such as personal computers and word processors have come into widespread use. At the same time, efforts are being made to develop various types of printing apparatus that output information supplied from these devices and to enhance printing speed and print quality of these printing apparatus. Among others, a serial type ink jet printing apparatus is drawing attention as a relatively small printing apparatus capable of producing prints at low cost at high speed or with high quality. Such a serial type ink jet printing apparatus can perform a bidirectional printing to produce an image at high speed or perform a multi-pass printing to produce an image with high quality. Brief descriptions are made in the following as to the bidirectional printing and multi-pass printing in the serial type ink jet printing apparatus.

(Bidirectional Printing)

In a serial type ink jet printing apparatus, a print head having an array of ink drop ejection nozzles integrally formed therein is mounted in a carriage that is moved in a main scan direction in the printing apparatus. Individual nozzles (or ejection ports) of the print head eject ink according to image data as the carriage is moved, to form one band of image. A printing main scan (also referred to simply as a printing scan) of one band and an operation to convey a print medium one band width are alternated repetitively to form one band of image after another on the print medium.

The bidirectional printing is a printing method that, after completing a forward printing scan and the subsequent print medium convey operation, performs a printing scan in the backward direction. Compared with a one-way printing that repeats the process of performing the backward scan without printing operation followed by the printing scan, the bidirectional printing can shorten the printing time. For example, suppose an entire area of the A4-size print medium is to be printed using a print head that has 64 nozzles arrayed therein at a density of 360 dpi (dots/inch) in the print medium conveying direction. In that case, while the one-way printing requires about 60 reciprocal scans including backward scans without printing operation, the bidirectional printing needs only about 30 such reciprocal scans to complete the printing. This means the bidirectional printing can produce an image at almost twice the speed of the one-way printing.

(Multi-Pass Printing)

In a printing operation using a print head having a plurality of nozzles, the quality of an image produced is affected by ejection characteristics of individual nozzles. In a process of manufacturing nozzles of the print head, there inevitably occur some variations in the heating characteristics of electrothermal transducers (heaters) installed in the nozzles that generate an ejection energy and also in the shape of ejection openings. These variations influence the ejection volume and direction of ink ejected from the nozzles, which in turn generates density unevenness and stripes in an image formed on a print medium.

FIGS. 1A-1C show a printing state of a print head that has no ejection characteristic variations. In the figures, reference number 201 represents a print head which, for the sake of simplicity, is shown to have only eight nozzles 202 here. As shown in FIG. 1A, if the sizes and the ejection directions of ink droplets 203 ejected from nozzles are aligned, an arrangement of dots formed on a print medium are to be such as shown in FIG. 1B and a density unevenness in the direction of nozzle array are uniform as shown in FIG. 1C respectively.

FIGS. 2A-2C show a printing state of a print head that has ejection characteristic variations. The sizes and ejection directions of ink droplets ejected from individual nozzles 202 vary as shown in FIG. 2A. The dot arrangement on a print medium is also not uniform, as indicated in FIG. 2B. It is seen that there are some areas where dots overlap each other more than necessary and also blank areas where an area factor is less than 100%. As a result, the density unevenness in the direction of nozzle array is uneven, as shown in FIG. 2C. These non-uniform areas, if repeated in the sub-scan direction, are recognized as density unevenness.

FIGS. 3A-3C show a printing state when a multi-pass printing is done using the print head of FIGS. 2A-2C. As shown in FIG. 3A, the multi-pass printing completes a printing operation on an area that in a one-pass printing can be printed in a single printing scan, by dividing the printing scan into a plurality of printing scans. Here is shown a 2-pass printing method.

FIGS. 4A-4C show an arrangement of dots permitted to be printed by the individual nozzles in three consecutive printing scans. FIG. 4A shows dots permitted to be printed in the first printing scan. Here is shown about half the number of dots printed in this area of print medium and they are arranged on alternate pixels in vertical and horizontal directions. After the first printing scan, the print medium is conveyed half the printing width of the print head (equivalent to 4 dots in this case) in the sub-scan direction. In the subsequent second printing scan the remaining half of the dots that are also arranged on alternate pixels are printed (FIG. 4B) It is noted that they are printed at positions complementary to those dots printed in the first printing scan, i.e., they are printed where dots were not printed in the first printing scan. After another 4-dot conveying operation is finished, about half the dots are again printed in the third printing scan at positions complementary to those dots printed in the second printing scan (FIG. 4C). By repeating the above printing scan and the conveying operation alternately, an image is formed on the same image area (each unit image area) on a print medium by two printing scans of different parts of the print head.

The multi-pass printing described above prevents the dots printed by one nozzle from being connected in line in the main scan direction as shown in FIG. 2B. That is, the multi-pass printing allows the use of a print head equivalent to the print head 201 of FIG. 2A and can still halve adverse effects the ejection characteristic variations among the nozzles have on the print medium image, with a resultant dot arrangement being as shown in FIG. 3B. As a result, the density unevenness in the nozzle alignment direction is almost uniform as shown in FIG. 3C.

FIG. 23 is a schematic diagram for explaining a mask pattern capable of using for 2-pass printing described FIG. 4A to 4C and a completing relationship of the mask. P0001 denotes nozzle array consist of 8 nozzles for ejecting ink of same color. The nozzle array is divided into a first block and a second block each including 4 nozzles. P0002A and P0002B denote mask patterns corresponding to the first block and the second block respectively and each mask pattern has 4 pixels×4 pixels area. P0002A (lower pattern in FIG. 7) is a mask pattern used for a first scan, and P0002B (upper pattern in FIG. 7) is a mask pattern used for a second scan. Each mask pattern (P0002A and P0002B) consist of arrangement of print permitted pixels indicated by black and print non-permitted pixels indicated by white. The mask pattern P0002A for the first scan and the mask pattern P0002B for the second scan have completing relationship each other. Therefore, superimposing them, all of 4 pixels×4 pixels area is filled, and up to 100% printing become possible. Then, as such mask pattern is used repeatedly for the main scan direction 2-pass printing becomes possible for all of area where the print head scans.

Next, the "print permitted pixel" and the "print non-permitted pixel" will be described. The "print permitted pixel" means a pixel in which a dot is permitted to be printed. That is, when a 2-value image data corresponding to the "print permitted pixel" indicates ejecting ink, a dot is printed to the pixel. And when the 2-value image data indicates not-ejecting ink, a dot is not printed to the pixel. On the other hand, the "print non-permitted pixel" means a pixel in which a dot is not permitted to be printed regardless of the 2-value image data. That is, even if the 2-value image data corresponding to the "print non-permitted pixel" indicates ejecting ink, a dot is not printed to the pixel.

P0003 and P0004 denote an arrangement of dots in an image which is completed by 2-pass printing. In the first scan, 2-valued image data generated by using mask pattern P0002A is printed by the first block. Then, the print medium is conveyed, in the direction of an arrow, by a distance corresponding to width of one block. In the following second scan, in a similar way, 2-valued image data generated by using mask pattern P0002A is printed by the first block. At the same time, in the second scan, 2-valued image data generated by using mask pattern P0002B is printed by the second block. In this way, a printing for an area corresponding to half of nozzle arraying region capable of being used in a 2-pass printing mode, is completed by 2 times printing scans.

Although in the above explanation dots have been described to be arranged at alternate pixels in both vertical and horizontal directions in each printing scan, the multi-pass printing is not limited to such a dot arrangement. The positions at which dots are printed in each printing scan are generally determined by an arrangement of print permitted pixels in a mask pattern. It is therefore possible to adjust the dot arrangement and the print permitted ratio by changing the arrangement and ratio of print permitted pixel in the mask pattern. It is noted that, the "print permitted ratio" determined by a mask pattern is a ratio, which is expressed in percentage, of a number of print permitted pixels of a total number of the print permitted pixels and print non-permitted pixels in the mask pattern.

The 2-pass printing has been described in the above. The multi-pass printing may increase the number of passes to 3, 4 and 5 passes to enhance the uniformity of image quality. An increase in the number of passes, however, results in a reduction in the printing speed. So, many printing apparatus has a plurality of print modes with different number of passes, such as one that gives priority to image quality and one that places importance on printing speed. By using the bidirectional printing described earlier, it is possible to strike a balance between the image quality and the printing speed to provide a more appropriate print mode. It should, however, be noted that when a bidirectional multi-pass printing is performed using an odd number of passes in, a new problem that does not emerge in a multi-pass printing with an even number of passes arises.

FIGS. 5A and 5B are schematic diagrams showing a difference between an even-numbered-pass printing (with 4 passes) and an odd-numbered-pass printing (with 3 passes).

The bidirectional printing performs a printing operation in both the forward scan and backward scan. If the print heads for a plurality of inks are parallelly arranged in the main scan direction, the order in which the inks are applied to a print medium during the backward scan is reverse to that of the forward scan. For example, if during a forward scan inks are applied in the order of black, cyan, magenta and yellow, the backward scan applies inks in the order of yellow, magenta, cyan and black. At this time, even if the plurality of ink colors are ejected in the same percentages in both the opposite scans to produce the same image colors, there inevitably occurs some color difference between an image obtained in the forward scan and an image obtained in the backward scan. Further, if the printing is done using a single color or the print heads for a plurality of ink colors are arranged in the sub-scan direction, some printing characteristic differences, such as differences in dot shape resulting from satellite landing position variations, emerge between the forward scan and the backward scan. As a result, there is some density differences between images formed in the forward scan and the backward scan.

Thus, even where the multi-pass printing is performed, it is desired that there be no difference in the number of dots between the forward scan and the backward scan. Take FIG. 5A for example; in the case of an even-numbered-pass printing with four passes, the forward and backward scans are executed two times each over the same image area of a print medium: the same image area being a unit area having a width corresponding to a conveying distance of the print medium between pass and pass. Therefore, if the each printing scans for the same image area is given a print permitted ratio of 25%, the total print permitted percentage of the forward scans and that of the backward scans are both 50%.

However, in the case of an odd-numbered-pass printing with three passes shown in FIG. 5B, the numbers of times that the forward scan and the backward scan are executed over the same image area (unit area) of a print medium are not equal. The same image areas (unit areas) printed by two forward scans and one backward scan and the same image areas (unit areas) printed by one forward scan and two backward scans are alternated in the sub-scan direction. That is, if the print permitted ratio for each printing scan is uniformly set at 33.3%, then image areas with a strong printing characteristic of forward scan where the number of dots printed by the forward scan is 33.3% more than that of the backward scan and image areas with a strong backward scan printing characteristic where the number of dots printed by the backward scan is 33.3% more than that of the forward scan, are formed alternately. Since colors and densities may differ between these two kinds of image areas, overall image impairments such as color unevenness and density variations are likely to occur.

The image impairments described above caused by the bidirectional printing with an odd number of passes emerge with an increasing distinctiveness as the number of passes decreases. That is, a three-pass bidirectional printing with a print permitted ratio difference of 33.3% between the sum of forward scans and the sum of backward scans makes the image impairments most noticeable. If the print permitted ratio in each printing scan is equally set, the print percentage difference decreases to 20% and 14.3% as the number of passes increases to 5 passes and 7 passes, making the image impairments less noticeable.

As to the bidirectional printing with an odd number of passes, Japanese Patent Laid-Open No. 2000-108322 discloses a construction in which a print permitted ratio is differentiated according to nozzle positions in the print head in order to make the sum of print permitted ratios in forward scans and the sum of print permitted ratios in backward scans equal.

FIG. 6 is a schematic diagram showing print permitted ratios of forward scans and backward scans in 3-pass bidirectional printing disclosed in Japanese Patent Laid-Open No. 2000-108322. According to this patent document, a nozzle array of the print head is divided into three blocks, with both side blocks assigned a print permitted ratio of 25% each and a central block assigned a print permitted ratio of 50%. With this arrangement, areas printed by forward scan followed by backward scan followed by forward scan and areas printed by backward scan followed by forward scan followed by backward scan can both have equal numbers of dots capable of being printed by the forward scans and the backward scans. If these numbers of dots cannot be made perfectly equal as shown in FIG. 6, the print permitted ratios of the three divided blocks of the print head nozzle array can be determined in a way that suppresses a difference between the number of dots printed by the forward scan and the number of dots printed by the backward scan.

FIG. 7 is a schematic diagram showing a nozzle array of the print head divided into three blocks, of which upper and bottom blocks are given a print permitted ratios of 30% and a central part 40%. This arrangement can suppress the difference in print permitted ratio between the forward scans and the backward scans to about 20%, if not 0%. If a mask used has too large difference in a print permitted ratio between the central block and end block of the nozzle array, the intended effect of the multi-pass printing of "making the ejection characteristics of individual nozzles less noticeable on a printed image" is lost. This also gives rise to a possibility that the print head longevity may be shortened to a level similar to the life of a nozzle with a large ejection frequency. Thus, it is preferred to use a mask, such as described earlier, that makes inconspicuous image impairments caused by differences in print permitted ratio between forward scans and backward scans and which keeps the print permitted ratio differences small. That is, for providing benefits of multi-pass printing or head longevity described above, the mask pattern of FIG. 7 with small difference in print permitted ratios between forward scans and backward scans has more effective than the mask pattern of FIG. 6 with large difference in print permitted ratios between forward scan and backward scan.

In the following, a mask pattern in which a print permitted ratio of at least one printing scan of plural scans is different from that of other scans, as described above, is referred to as a stepping mask. That is, the stepping mask is a mask wherein print permitted ratios of each printing scans are not equal. On the other hand, a conventional commonly used mask that sets print permitted ratios of different printing scans equal is referred to as a flat mask.

In an ink jet printing apparatus that ejects ink from the print head to print an image, ink droplets ejected from the nozzles are not always stable as they leave the nozzles. When ink is ejected as a droplet from a nozzle opening, a main droplet of a relatively large volume, which is ejected first, is often followed by a smaller, slower sub droplet. Since the print head performs ejection as it moves relative to the print medium, the sub droplets which are slower than the main droplets land on the print medium at positions deviated from the main droplets in the direction of movement of the main scan, forming small dots—satellites.

FIG. 8 is a schematic diagram showing a positional relation on a print medium between a main dot formed of a main droplet and a satellite formed of a sub droplet. The diagram shows that the satellite position with respect to the main dot position during the backward scan is reverse to that of the forward scan. That is, when a bidirectional multi-pass printing is executed, dots printed by the forward scan and dots printed by the backward scan mix together in the same image area (e.g., in the same pixel, on the same pixel line or in the same M×N pixel area).

Such a satellite, if it occurs, will get printed at the same position as the main dot or, if it is small enough compared with the main dot, will not pose any problem to the image quality. However, in the case of print heads that eject high-resolution, small droplets of ink, such as those developed in recent years, main dots themselves are small in diameter, making the presence of satellites not negligible. When two kinds of ink are overlapped to produce a secondary color, in particular, the problem becomes worse.

FIGS. 9A and 9B show how cyan and magenta dots are overlapped to produce a blue color. FIG. 9A shows a printing state wherein two blue dots are formed in a 2×2 pixel area by moving a carriage in a forward direction of arrow. FIG. 9B shows a printing state wherein two blue dots are formed in a 2×2 pixel area by moving the carriage in a backward direction of arrow. Here, it is assumed that two print heads of cyan and magenta have the same satellite generation conditions. By the side of the blue dots (second color main dots) formed of main droplets, satellites (second color satellites) are shown to be formed by two overlapping color dots. These second color satellites formed of two overlapping color dots are more conspicuous than first color satellites and therefore more likely to affect the image quality. Additionally, in each pixel in FIGS. 9A and 9B, the second color satellites placed in one side of the main dots, so the satellites are distributed unevenly. Unevenly distributed, conspicuous satellites inevitably make the printed image look more granular and lose uniformity, degrading the image quality.

A technique to overcome the uneven distribution is disclosed in Japanese Patent Laid-Open No. 2007-38671. Japanese Patent Laid-Open No. 2007-38671 discloses a construction in which satellites of two types of the inks (cyan and magenta) in the same pixel are printed at symmetric positions with respect to main dots.

However, concrete configuration of preferred mask pattern capable of being used for odd-numbered-pass bidirectional printing is not mentioned in Japanese Patent Laid-Open No. 2007-38671. In this way, regarding the conventional mask pattern for odd-numbered-pass printing, positions of satellites of a plurality of dots printed at the same position are not to be considered.

FIG. 10 is a schematic diagram showing an example case in which a same stepping mask is used for both cyan and magenta. Considering an image area, 30% printing is performed in a first scan for both cyan and magenta ink. In a second scan whose direction is opposite that of the first scan, 40% printing is executed. In a third printing scan whose direction is the same as that of the first scan, 30% printing is performed. Since the same mask pattern is used for cyan and magenta, cyan dot and magenta dot landing a same pixel are printed by scans in a same direction. In this case, as a blue image is constructed such as showed in FIG. 9A or FIG. 9B, the satellites are distributed unevenly causing an image degradation.

In this way, in the conventional technologies, an odd-numbered-pass bidirectional printing fails to distribute satellite landing positions uniformly. As a result, with the odd-numbered-pass bidirectional printing, it was impossible to solve the problem of image impairments caused by biased position of satellites. Additionally, it was also impossible to solve both the problem of image impairments caused by a difference in print permitted ratio between forward scans and backward scans and the problem of image impairments caused by a biased position of satellites.

SUMMARY OF THE INVENTION

The present invention has been accomplished to solve the above problems. It is an object of this invention to suppress image impairments caused by biased position of satellites. Additionally, it is also an object of this invention to solve both the problem of image impairments caused by a difference in print permitted ratio between forward scans and backward scans and the problem of image impairments caused by biased position of satellites.

In a first aspect of the present invention, there is provided an ink jet printing apparatus capable of performing a bidirectional printing for printing an image on a print medium by a print head capable of ejecting at least two types of inks during forward and backward movements of the print head, the apparatus comprising: means for executing the bidirectional printing according to two types of mask patterns corresponding to the two types of inks by M (M is an odd number equal to 3 or more) times movements of the print head, between which the print medium is conveyed by a distance smaller than a length of the print head, wherein print permitted pixels and print non-permitted pixels of the two types of mask patterns are arranged in such a way that a percentage of pixels permitted to be printed with two types of inks by the movements of different directions is higher than a percentage of pixels permitted to be printed with the two types of inks by the movements of the same direction.

In a second aspect of the present invention, there is provided an ink jet printing apparatus capable of performing a bidirectional printing for printing an image on a same image area of a print medium by a print head for ejecting at least two types of inks during forward and backward movements of the print head, the apparatus comprising: a mask pattern for dividing an image data corresponding to the same image area into image data corresponding to M (M is a odd number equal to 3 or more) times movements, the mask pattern consisting of arrangement of print permitted pixels and print non-permitted pixels; and means for executing the bidirectional printing to the same image area according to the image data divided by the mask pattern; wherein print permitted pixels and print non-permitted pixels of the mask pattern are arranged in such a way that a percentage of pixels permitted to be printed with the two types of inks by the movements of different directions is higher than a percentage of pixels permitted to be printed with the two types of inks by the movements of the same direction.

In a third aspect of the present invention, there is provided A printing system including an ink jet printing apparatus and a control apparatus for controlling the ink jet printing apparatus, the ink jet printing apparatus being capable of performing a bidirectional printing for printing an image on a same image area of a print medium by a print head for ejecting at least two types of inks during forward and backward movements of the print head, the printing system comprising: means for executing the bidirectional printing to the same image area according to two types of mask patterns corresponding to the two types of inks by M (M is an odd number equal to 3 or more) times movements of the print head, between which the print medium is conveyed by a distance smaller than a length of the print head, wherein print permitted pixels and print non-permitted pixels of the two types of mask patterns are arranged in such a way that a percentage of pixels capable of being printed with two types of inks by the movements of different directions is higher than a percentage of pixels not capable of being printed with the two types of inks by the movements of the same direction.

In a fourth aspect of the present invention, there is provided An ink jet printing method capable of performing a bidirectional printing for printing an image on a same image area of a print medium by a print head for ejecting at least two types of inks during forward and backward movements of the print head, the method comprising the steps of: dividing an image data corresponding to the same image area into image data corresponding to M (M is a odd number equal to 3 or more) times movements according to a mask pattern consisting of arrangement of print permitted pixels and print non-permitted pixels; and executing the bidirectional printing to the same image area by the M times movements according to the image data divided by the dividing step, wherein print permitted pixels and print non-permitted pixels of the mask pattern are arranged in such a way that a percentage of pixels permitted to be printed with the two types of inks by the movements of different directions is higher than a percentage of pixels permitted to be printed with the two types of inks by the movements of the same direction.

Further features of the present invention will become apparent from the following description of exemplary embodiments (with reference to the attached drawings).

BRIEF DESCRIPTION OF THE DRAWINGS

FIG. 17 shows overlapping factors among individual patterns for print-permitted pixels when all of the conditions of the second embodiment are met;

FIG. 18 shows overlapping factors among individual patterns for print-permitted pixels when the mask patterns A10-F10 are actually used;

FIG. 22 shows, for print-permitted pixels, overlapping factors among individual patterns of a mask prepared by the inventors of this invention so as to meet the conditions of the second embodiment.

DESCRIPTION OF THE EMBODIMENTS

Now, embodiments of this invention will be explained in detail.

Figure 11:
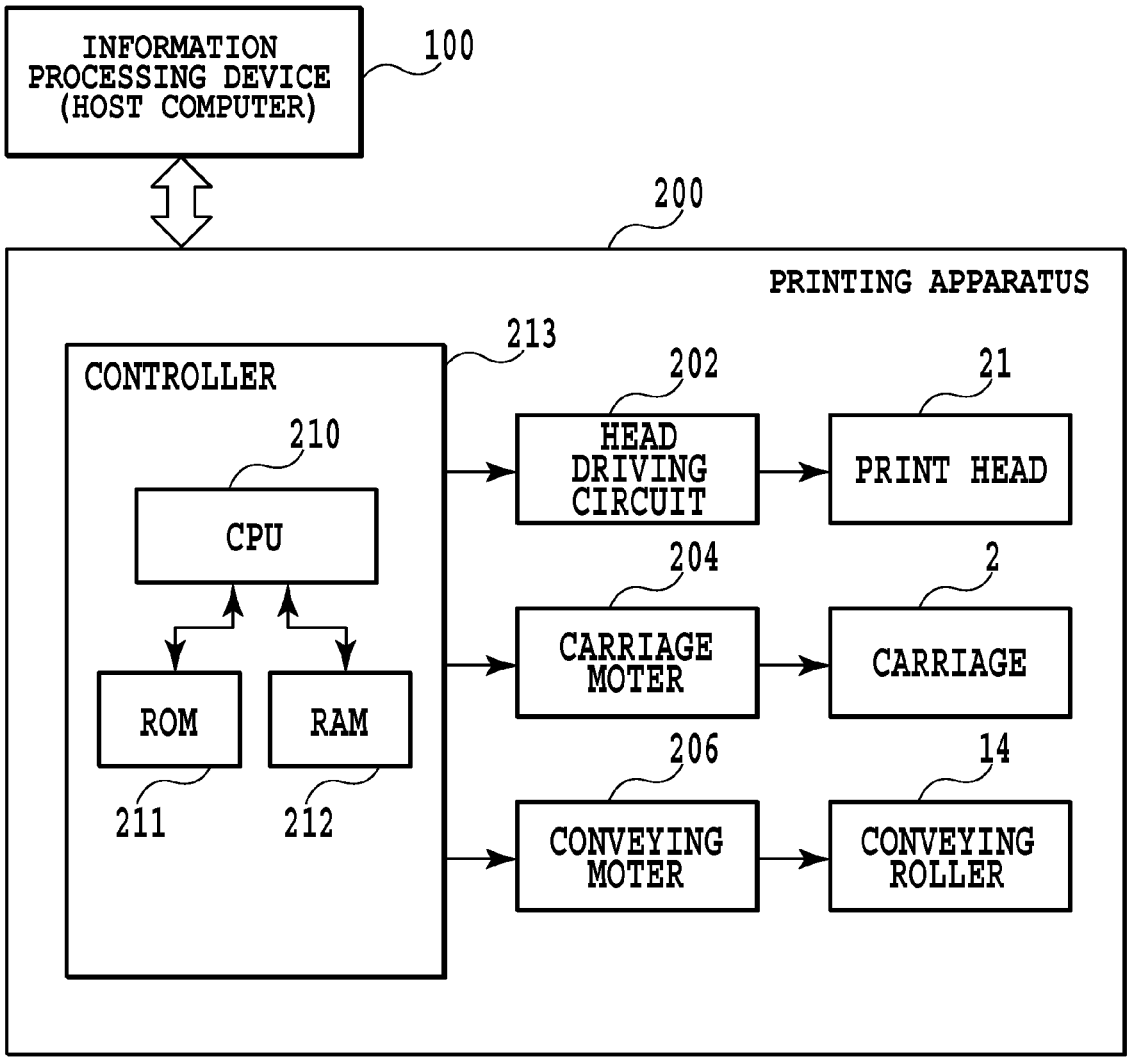
FIG. 11 is a block diagram showing a control construction of a printing system including the printing apparatus and a control device (host computer) of this embodiment.

FIG. 11 shows a control construction of a printing system including a printing apparatus 200 and an information processing device 100 (host computer) in this embodiment. Denoted 200 is an apparatus which performs printing by ejecting ink from a print head and 100 a control device which assumes a role for supplying image data to the apparatus and a role for controlling the apparatus 200. The printing apparatus 200 and the control device 100 are connected through a known communication means for mutual communication. A user may access the control device 100 to generate image data for the printing apparatus 200 and have the printing apparatus 200 print the print data. In the control device, one print mode can be set from the plurality of print mode selectively. For details, there is a construction in which one print mode is selectively set from the plurality of print mode based on a combination of "kind of printing medium" and "printing quality" selected by user. Then, the information regarding to print mode set in the information processing device 100 is transmitted to the printing apparatus 200. In the printing apparatus 200, a printing mode to be performed is set based on the information transmitted.

M-pass bidirectional print modes (M is an odd number equal to 3 or more), such as 3-pass, 5-pass, 7-pass printing mode, are included in the plurality of print modes which can be performed in the printing apparatus. The M-pass bidirectional print mode is a print mode in which a bidirectional printing by M times scan of print head is performed for an area having a width corresponding to a conveying distance of the print medium: each conveying operations being performed between each scans by a distance small than a length of the nozzle arraying region. In a 3-pass print mode, for example, by three scans of print head, image is printed in an area having one third length of the nozzle arraying region wherein nozzles capable of being used in the 3-pass print mode: each of the scans being performed between conveying operations by a distance corresponding to the one third length of the nozzle arraying region.

In the printing apparatus 200, controller 213, print head 21, head driving circuit 202, carriage 2, carriage motor 204, conveying roller 14, conveying motor 206 and the like are provided. The head driving circuit 202 is for driving the print head 21 to eject an ink from it. The carriage motor 204 is a motor for causing a carriage 2 mounting the print head 21 in it to move reciprocatelly. The conveying motor 206 is a motor for causing the conveying roller 14 to convey the printing medium. In the controller 213 for controlling all of the apparatus, CPU 210 having a configuration of a micro processing unit, ROM 211 in which control programs are stored, RAM 212 used by the CPU 210 for processing an image data, and the like are provided. In ROM 211, a plurality kind of mask patterns corresponding to a plurality of print mode (e.g. mask patterns showed in FIG. 16 or 21) and control programs for controlling the multi-pass printing are stored. Controller 213 sets one print mode to be executed according to information about print modes transmitted from the information processing apparatus 100. Additionally, controller 213 controls the head driving circuit 202, carriage motor 204 and conveying motor 206 to execute a multi-pass printing and generates image data corresponding to each printing scan of the multi-pass printing. For details, the controller 213, according to the control program, divides an image data corresponding to a same image area (predetermined area) to generate image data corresponding to each printing scan by using the mask pattern read out from the ROM 211. Specifically, controller 213 generates thinned image data corresponding to each printing scan by thinning image data corresponding to the same image area using the mask pattern. In each printing scan, thinned image is printed according to the thinned image data, then a printing for the same image area is complete. Furthermore, controller 213 controls the head driving circuit 202 causing the print head 21 to eject ink according to the divided image data.

Figure 12:
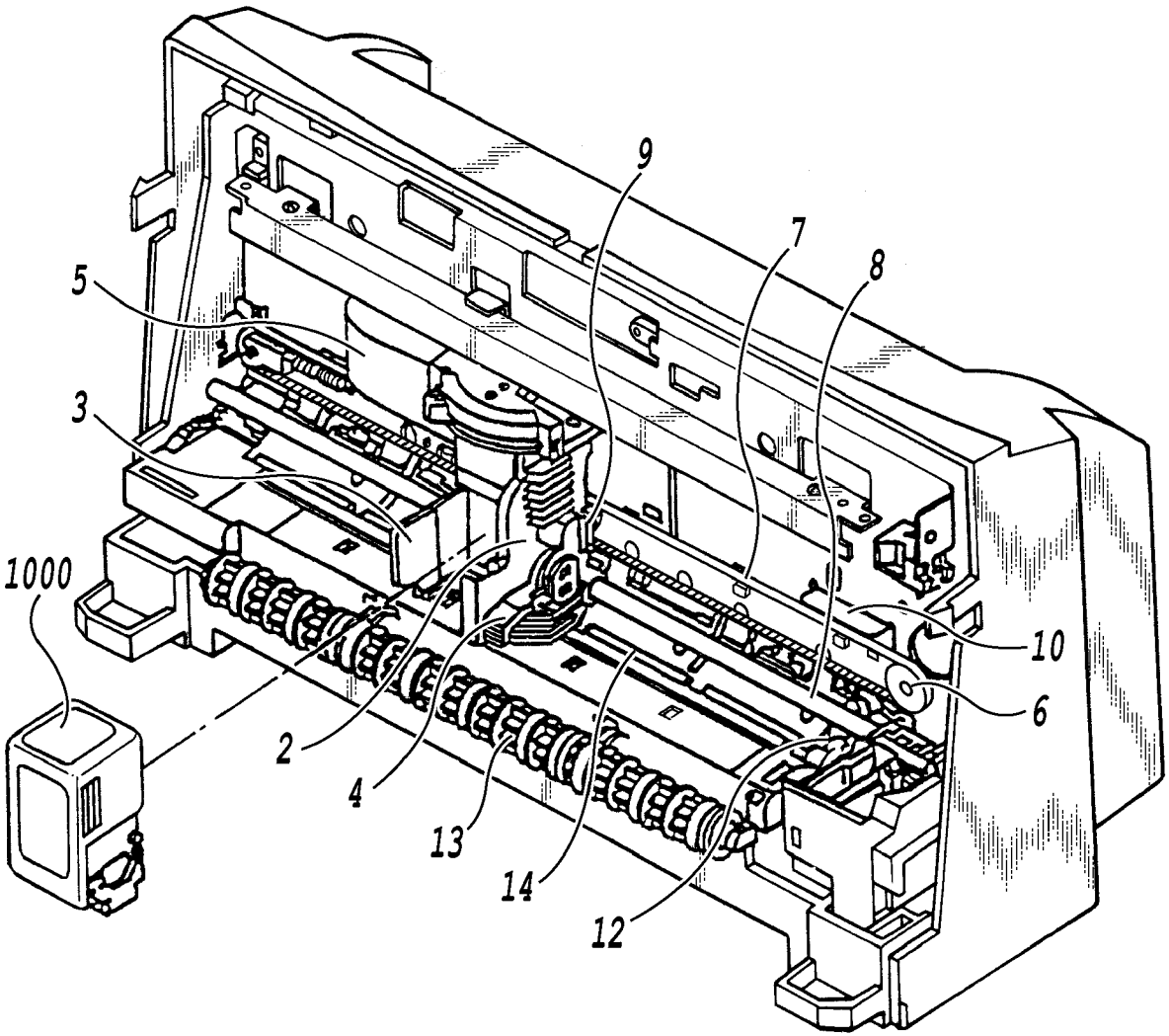
FIG. 12 is a perspective view showing an internal construction of an ink jet printing apparatus applicable to the present invention.

FIG. 12 is a perspective view showing an internal structure of an ink jet printing apparatus that can apply the present invention. In the figure, denoted 1000 is a replaceable head cartridge, which comprises an ink ejection print head 21 and an ink tank for supplying ink to the print head 21. Denoted 2 is a carriage on which the head cartridge 1000 is replaceably mounted. Reference number 3 represents a holder to securely hold the head cartridge 1000 to the carriage 2. With the head cartridge 1000 mounted in the carriage 2, a cartridge fixing lever 4 is operated to push the head cartridge 1000 against the carriage 2. This pushing action positions the head cartridge 1000 in its place, at the same time bringing a signal transmission contact in the carriage 2 into contact with an electric contact on the head cartridge 1000 side. Reference number 5 represents a flexible cable to transmit electric signals to the carriage 2.

Denoted 6 is a pulley which is linked to a carriage motor that drives the carriage 2 forwardly and backwardly in the main scan direction (first direction). Denoted 7 is a carriage belt to transmit the drive force to the carriage 2. A guide shaft 8 extends in the main scan direction and supports and guides the carriage 2.

A transmissive photocoupler 9 is attached to the carriage 2. Denoted 10 is a light shielding plate installed near the home position. When the carriage 2 reaches the home position, the light shielding plate 10 interrupts a light beam of the photocoupler 9, detecting that the carriage 2 is at the home position. Denoted 12 is a home position unit that includes a recovery system made up of a cap member capping a front of the print head, suction means to suck out ink from an interior of the cap member and a wiping member to wipe the front of the head.

A conveying roller 14 conveys the print medium a predetermined distance in the sub-scan direction (second direction) intersecting with the main scan direction. An moving operation that moves the carriage mounting the head cartridge 1000 while the print head 21 ejects ink and a conveying operation that conveys the print medium a predetermined distance by the conveying roller 14 are alternated repetitively to print an image on the print medium step by step.

Designated 13 is a discharge roller to discharge a print medium out of the printing apparatus by holding the print medium between it and a spur roller not shown.

Figure 13:
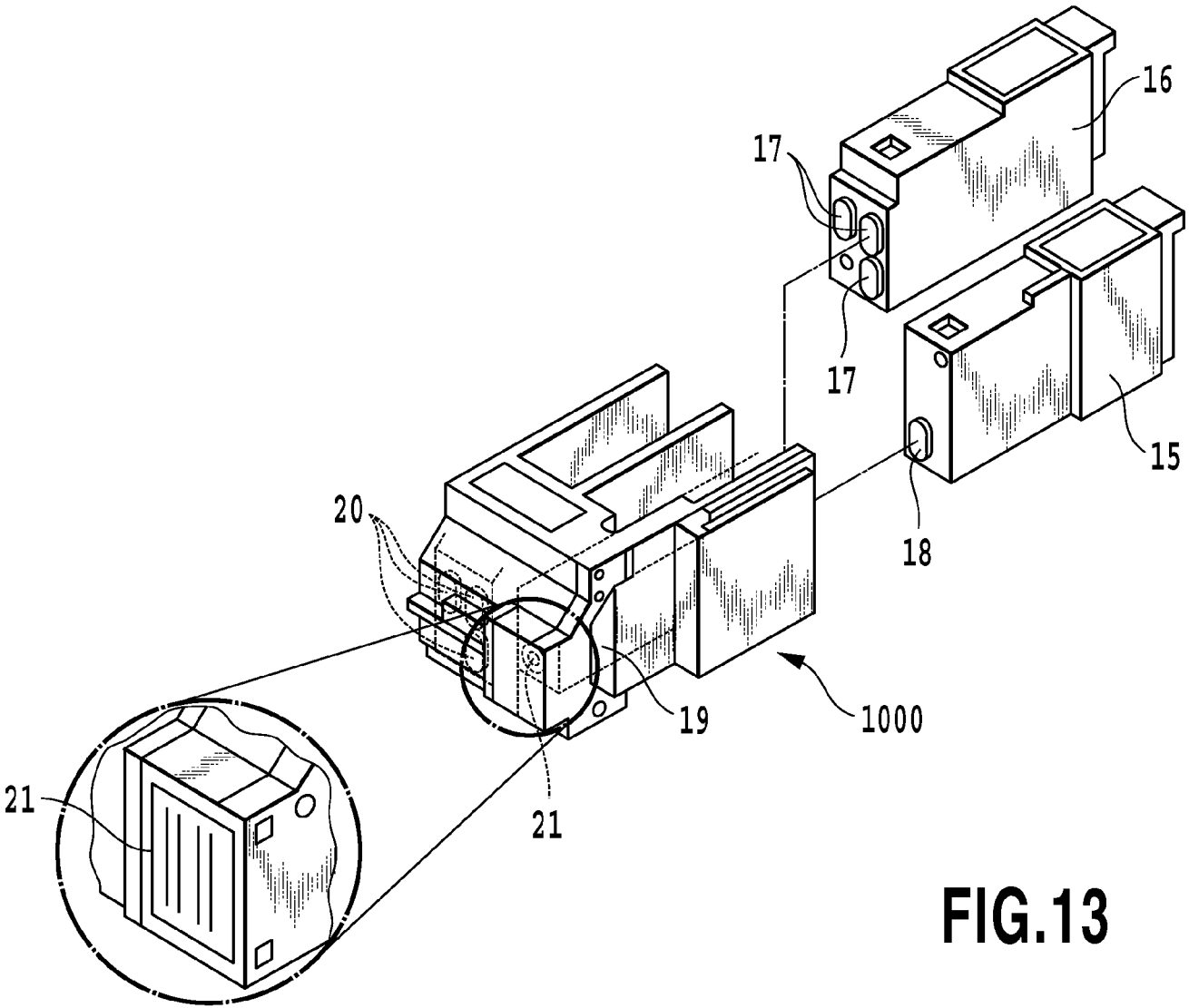
FIG. 13 is an exploded perspective view showing details of a head cartridge 1000.

FIG. 13 is a perspective view showing details of the head cartridge 1000. In FIG. 13, denoted 15 is a replaceable ink tank for Bk (black) ink. Denoted 16 is a replaceable ink tank for C (cyan), M (magenta) and Y (yellow) inks. Designated 17 are ink supply ports of the ink tank 16 that are connected to the head cartridge 1000 to supply ink to it. Similarly reference number 18 represents an ink supply port of the ink tank 15. The ink supply ports 17 and 18 are connected to supply pipes 20 to supply inks to the print head 21. An electric contact 19 is connected to the flexible cable 5 to transmit signals based on the print data to the print head 21.

In FIG. 13, a plurality of lines shown on the front face of the print head 21 represent four arrays of ink ejection nozzles, that eject Bk (black) ink, C (cyan) ink, M (magenta) ink and Y (yellow) ink respectively.

Figure 14:
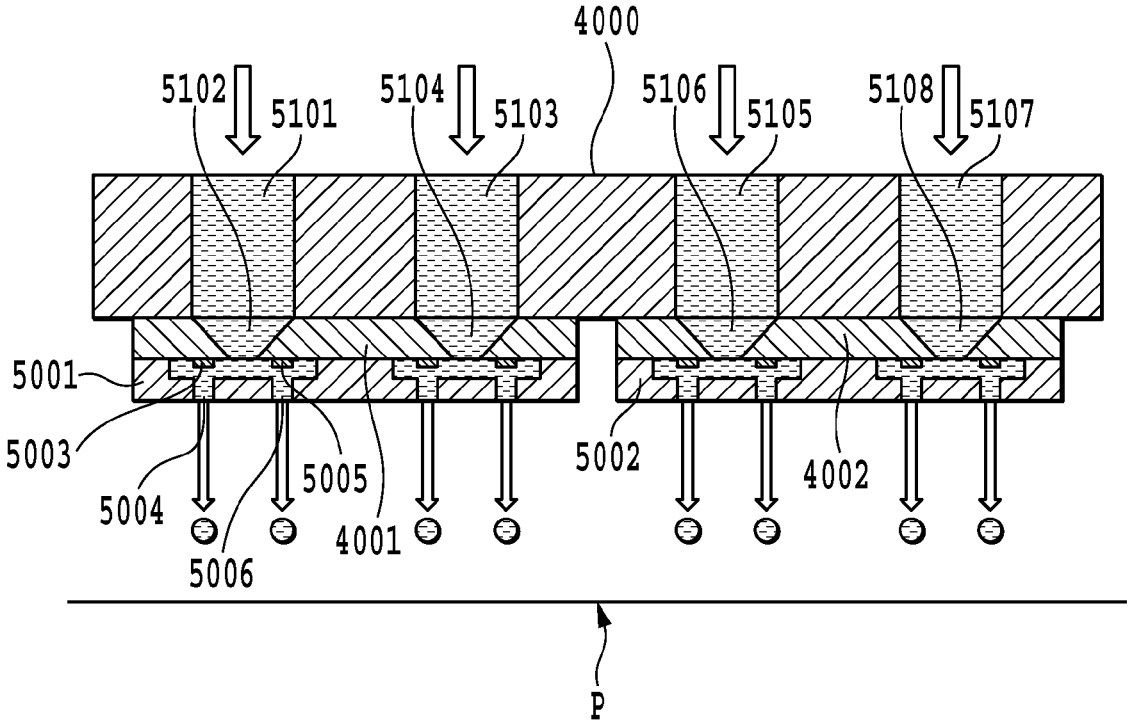
FIG. 14 is a schematic side cross-sectional view showing a nozzle structure in a print head 21.

FIG. 14 is a schematic side cross-sectional view showing a nozzle construction in the print head 21. Denoted 5102, 5104, 5106 and 5108 are common liquid chambers that accommodate respective color inks and correspond to black, cyan, magenta and yellow ink in that order. The common liquid chambers 5102-5108 are anisotropically etched in the back of heater boards 4001, 4002, that are fabricated with a semiconductor process. The common liquid chambers 5102-5108 communicate with a group of liquid paths (5004 and 5006) corresponding to a group of heaters (5003 and 5005). In the ink supplied to individual liquid paths a bubble is generated by a rapid energization of the heater triggered by the print signal. The bubble generation energy expels an ink droplet of a predetermined volume from an ejection opening of a nozzle toward the print medium P. In this specification, an ink ejection element made up of one heater, one liquid path and one ejection opening is referred to as a nozzle.

Although in FIG. 13 four nozzle arrays are shown to be arranged on the print head 21, the actual print head of this embodiment, as shown in FIG. 14, supplies inks of the same color from one common liquid chamber to the two nozzle arrays one on each side of the common liquid chamber. Here, the left side nozzle array 5004 in FIG. 14 is called even-numbered nozzles and the right side nozzle array 5006 is called odd-numbered nozzles. For other ink colors, the similar construction is also employed in the common liquid chamber and the nozzle arrays. Such a construction, however, does not characterize this invention. The print head may have a construction that allows individual color inks to be ejected from corresponding single arrays.

5101, 5103, 5105 and 5107 in a base plate 4000 form a part of the common liquid chambers 5102, 5104, 5106, 5108. Denoted 5001 and 5002 are orifice plates formed with nozzles, which are normally made of a heat resistant resin.

First Embodiment

Characteristic constructions of this invention will be explained as follows. This embodiment provides a characteristic construction of a stepping mask (arrangement of print permitted pixels) that is used when performing a bidirectional printing with M scans (M is an odd number equal to or more than 3).

In the first embodiment a stepping mask is used, in which print permitted pixels and print non-permitted pixels are arranged such a way that a percentage of pixel in which two types of inks are permitted to be printed by scans in opposite directions is higher than a percentage of pixel in which two types of inks are permitted to be printed by scans in the same direction. For this construction, a percentage of pixels in which first color satellites are placed in both side of a second color main dot as showed in FIGS. 19A and 19B can be higher than a percentage of pixels in which the second color satellites are placed in one side of the second color main dot as showed in FIGS. 9A and 9B.

Figure 19A:
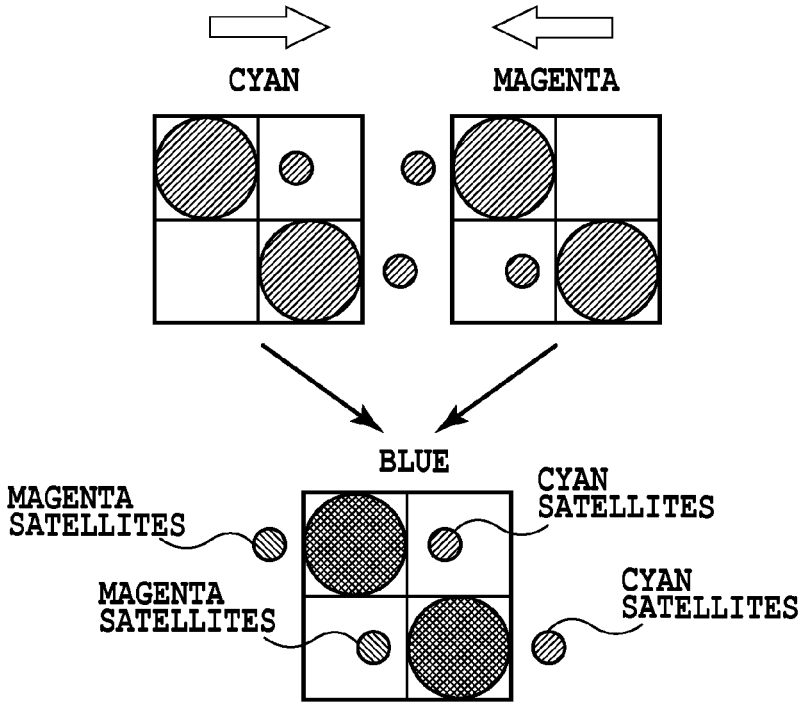
FIGS. 19A and 19B are diagrams showing a relation between mains dot and satellites in a same pixel wherein a cyan dot and a magenta dot are printed by scans in opposite direction respectively.
Figure 19B:
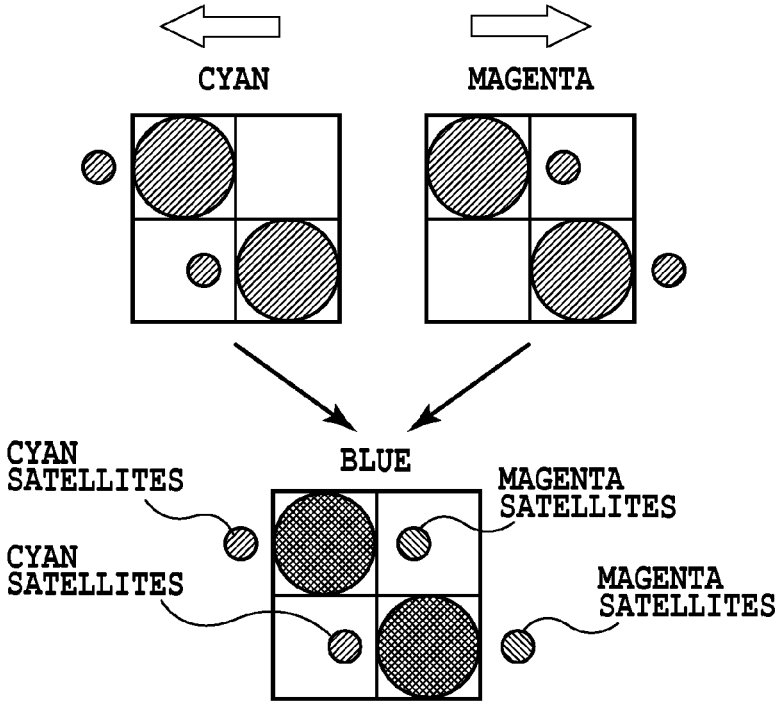

FIGS. 19A and 19B are diagrams showing a relation between a main dot and a satellite in a same pixel wherein a cyan dot (first color dot) and a magenta dot (second color dot) are printed by scans in opposite directions respectively. As showed in the diagrams, a cyan satellite (first color satellite) and a magenta satellite (first color satellite) are placed in both side of a blue dot (second color main dot) dividedly. For this construction, a distribution of position of the satellites relative to the main dot becomes evenly, image impairment caused by biased position of satellites dose not occur. Additionally, as each satellite is a first color, satellites themselves are not so conspicuous. Therefore, more high quality image can be obtained by setting the percentage of pixels such as showed in FIGS. 19A and 19B higher than that such as showed in FIGS. 9A and 9B.

In this embodiment, a difference in print permitted ratio between forward scans and backward scans of the stepping mask of this embodiment is smaller than that of the flat mask. That is, for the flat mask used in M-pass (M is an odd number equal to 3 or more) bidirectional print mode, the difference in print permitted ratio between forward scans and backward scans is equal to 100/M %. As described above, if the difference in print permitted ratio between forward scans and backward scans are equal to 100/M %, color unevenness or density unevenness may be conspicuous. Therefore, in this embodiment, a stepping mask, in which a difference in print permitted ratio among bidirectional scans (that is, a difference between a ratio of pixels which can be printed in forward movement and a ratio of pixels which can be printed in backward movement) is smaller than 100/M %, is used. In a case in which M (M is an odd number equal to 3 or more) times scan is performed, one of forward scan or backward scan is performed for (M−1)/2 times and the other scan is performed for (M+1)/2 times. Therefore, print permitted pixels in the mask pattern are may arranged such a way that a difference between a sum of print permitted ratios of (M−1)/2 scans and a sum of print permitted ratios of (M+1)/2 scans is smaller than 100/M %. This can more reduce the color unevenness or density unevenness than a case of using a flat mask.

Figure 15:
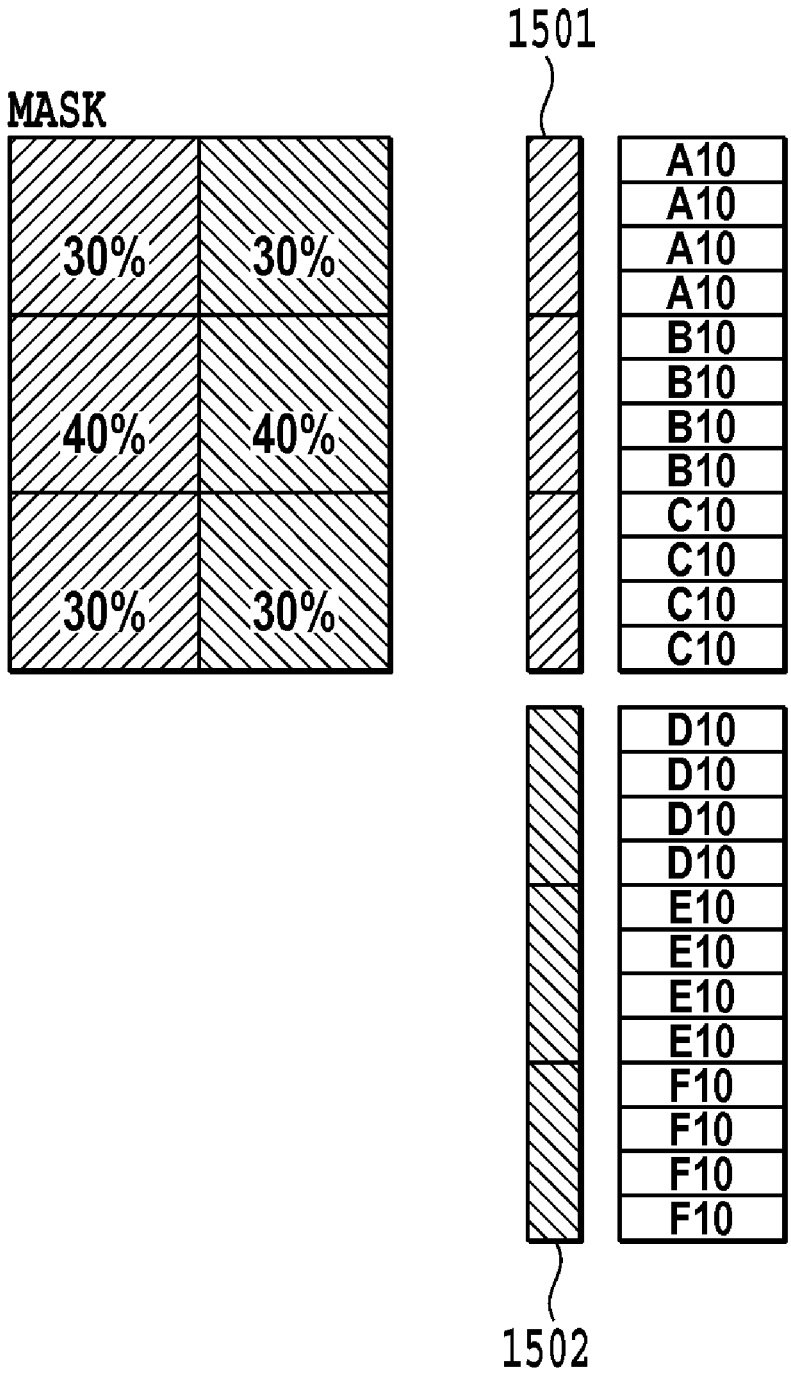
FIG. 15 a schematic diagram showing a construction of a mask employed in the first embodiment, with a cyan nozzle array 1501 and a magenta nozzle array 1502 separated for explanation.

A construction of the stepping mask used in this embodiment will be described specifically in following. FIG. 15 is a schematic diagram showing a construction of a mask for M=3 passes employed in this embodiment, with a cyan nozzle array 1501 and a magenta nozzle array 1502 shown separated for explanation. Here, the nozzle arrays for cyan and magenta are assumed to have 192 nozzles each for simplicity. The cyan nozzle array 1501 is divided into three blocks A-C of 64 nozzles each. The each blocks uses mask patterns each measuring 16 pixels in the nozzle alignment direction (sub-scan direction) and 32 pixels in the main scan direction. These mask patterns work as image data dividing means which divides cyan image data corresponding to a same image area into image data which are to be respectively printed by three scans of the print head. For example, four mask patterns A10 are arranged in the nozzle alignment direction for A block mask pattern. Similarly, B block mask pattern consists of four mask patterns of B10 and C block mask pattern consists of four mask patterns C10 respectively. Among three passes corresponding to a same image area, mask pattern C is used for a first pass, mask pattern B is used for a second pass and mask pattern A is used for a third pass.

As to the magenta nozzle array 1502, it is divided into three blocks D-F in the nozzle alignment direction, which use mask patterns D10, E10 and F10, respectively. Among three passes corresponding to a same image area, mask pattern F is used for a first pass, mask pattern E is used for a second pass and mask pattern D is used for a third pass.

Figure 16:
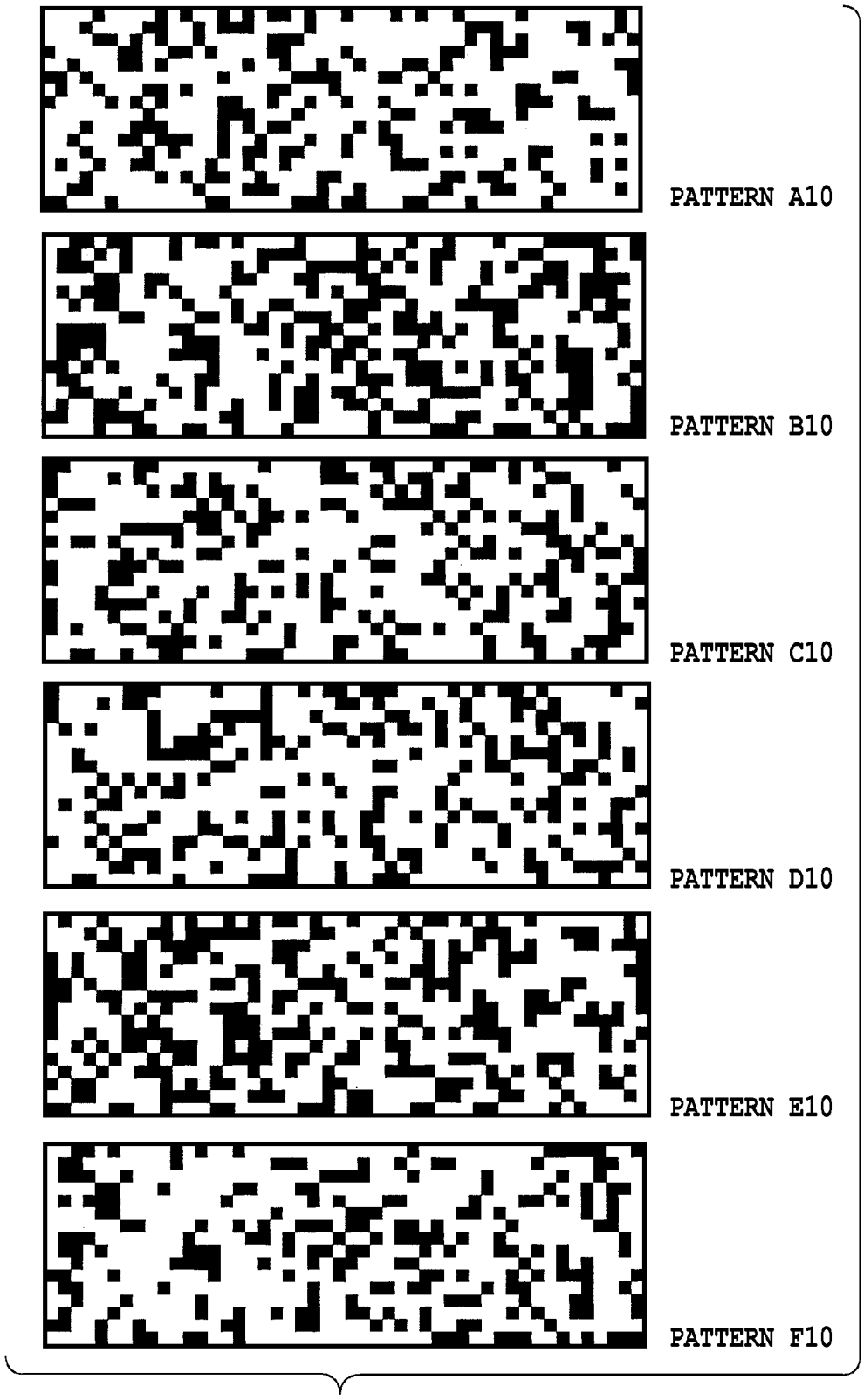
FIG. 16 shows mask patterns A10-F10 used in the first embodiment 1.

FIG. 16 is a diagram showing mask patterns A10-F10 used in this embodiment. A mask pattern having an area measuring 16 pixels in the sub-scan direction by 32 pixels in the main scan direction is constructed by arrangement of print permitted pixels (pixels indicated by black) or by arrangement of print non-permitted pixels (pixels indicated by white). The three different mask patterns A10, B10, C10 are complementary to one another. Overlapping these mask patterns permits all pixels in the 16×32-pixel area to be printed once respectively. That is, executing the printing scans by the cyan nozzle array 1501, each followed by the paper conveying by 64 pixels (sub-scan), a thinned image is formed by three printing scans according to each mask patterns. In this way, in the same image area of the print medium a 100% cyan image can be printed.

The similar relationship also holds for magenta. That is, the mask patterns D10, E10, F10 are complementary to one another. Overlapping these mask patterns results in a 100% magenta image being printed based on the image data.

This embodiment is characterized in that the cyan mask patterns A10-C10 and the magenta mask patterns D10-F10 are held in the following special relationship.

(1) The mask pattern A and the mask pattern D are assigned a print permitted ratio of 30%.

(2) The mask pattern B and the mask pattern E are assigned a print permitted ratio of 40%.

(3) The mask pattern C and the mask pattern F are assigned a print permitted ratio of 30%.

(4) Mask pattern A10 is included in mask pattern E10. That is, all of the print-permitted pixels of the mask pattern A10 are also print-permitted pixels of the mask pattern E10. In other word, among pixels in which magenta dot and cyan dot are printed, a pixel in which cyan dot is printed by the third pass is printed magenta dot by the second pass in an opposite direction of the third pass.

(5) Mask pattern F10 is included in mask pattern B10. That is, all of the print-permitted pixels of the mask pattern F10 are also print-permitted pixels of the mask pattern B10. In other word, among pixels in which magenta dot and cyan dot are printed, a pixel in which magenta dot is printed by the first pass is printed cyan dot by the second pass in an opposite direction of the first pass.

(6) The mask pattern A10 and the mask pattern D10 have their print-permitted pixels held in an exclusion relationship. That is, cyan dot and magenta dot are not printed in a same pixel by the third pass.

(7) The mask pattern B10 and the mask pattern E10 have their print-permitted pixels held in an exclusion relationship. That is, cyan dot and magenta dot are not printed in a same pixel by the second pass.

(8) The mask pattern C10 and the mask pattern F10 have their print-permitted pixels held in an exclusion relationship. That is, cyan dot and magenta dot are not printed in a same pixel by the first pass.

FIG. 17 shows overlapping factors among individual patterns for print-permitted pixels when all of the above eight conditions are met. To explain the effect of this embodiment that satisfies the above conditions, let us examine, by referring to FIG. 17, the direction of scan in which magenta dots are printed on those pixels that are printed with cyan dots by the blocks of the cyan nozzle array 1501.

First, let us look at a group of pixels that are printed with cyan dots by block A. According to the condition (4), all of these pixels are printed by block E. That is, all of the 30% print-permitted pixels that are permitted to be printed in cyan by block A are printed in magenta during the opposite printing scan.

Next, as to a group of pixels that are printed with cyan dots by block B, the condition (7) dictates that none of these pixels is printed by block E. That is, all of the 40% print-permitted pixels that are printed in cyan by block B are printed in magenta by either block D or block F during the opposite printing scan.

As to a group of pixels that are printed with cyan dots by block C, FIG. 17 shows that, of these pixels, 20% is printed with magenta dots by block D and 10% by block E. That is, of the 30% print-permitted pixels printed in cyan by block A, 10% pixels are printed in magenta by block E during the opposite printing scan.

That is, the percentage (probability) of pixels being printed with cyan dots and magenta dots in opposite printing scans is 30%+40%+10%=80%, which is much higher than 20%, a percentage of pixels being printed by the printing scans of the same direction. Therefore, the percentage of pixels in which first color satellites are placed in both side of a second color main dot as showed in FIGS. 19A and 19B, can be higher than the percentage of pixels in which a second color satellite is placed in one side of a second color main dot as showed in FIGS. 9A and 9B. By this construction, it becomes possible to obtain a high quality image, reducing a bias of satellite position and minimizing the appearance of the satellite itself.

The mask patterns A10-F10 shown in FIG. 16 meet all the above eight conditions. It is noted, however, that in a limited area of 16 pixels×32 pixels, the print permitted ratio cannot be set precisely at 30% or 40%. Thus, the overlapping factors for the print-permitted pixels among different mask patterns will not exactly be as shown in FIG. 17. FIG. 18 shows overlapping factors among individual mask patterns for print-permitted pixels when the mask patterns A10-F10 of FIG. 16 are actually used. Although these overlapping factors have some fractional differences from those of FIG. 17, it is seen that they are close to FIG. 17.

As described above, this embodiment provides cyan nozzle mask patterns and magenta nozzle mask patterns in order to meet the conditions of (4) to (8) in addition to the above conditions (1) to (3). Then, according to the mask patterns, a multi-pass printing with an odd number of scans is performed. For this construction, the percentage (probability) of cyan dots and magenta dots being permitted to be printed by opposite scans is higher than that of cyan dots and magenta dots being permitted to be printed by the same direction scans. In addition, regarding the stepping mask of this embodiment, the difference in print permitted ratio between forward scan and backward scan is equal to 20% that is smaller than 100/3% which is a difference in print permitted ratio between forward scans and backward scans in a case of using flat mask. As a result, image impairments caused by a difference in print permitted ratio between forward scans and backward scans and image impairments caused by biased position of satellites can be effectively minimized.

Second Embodiment

Figure 20:
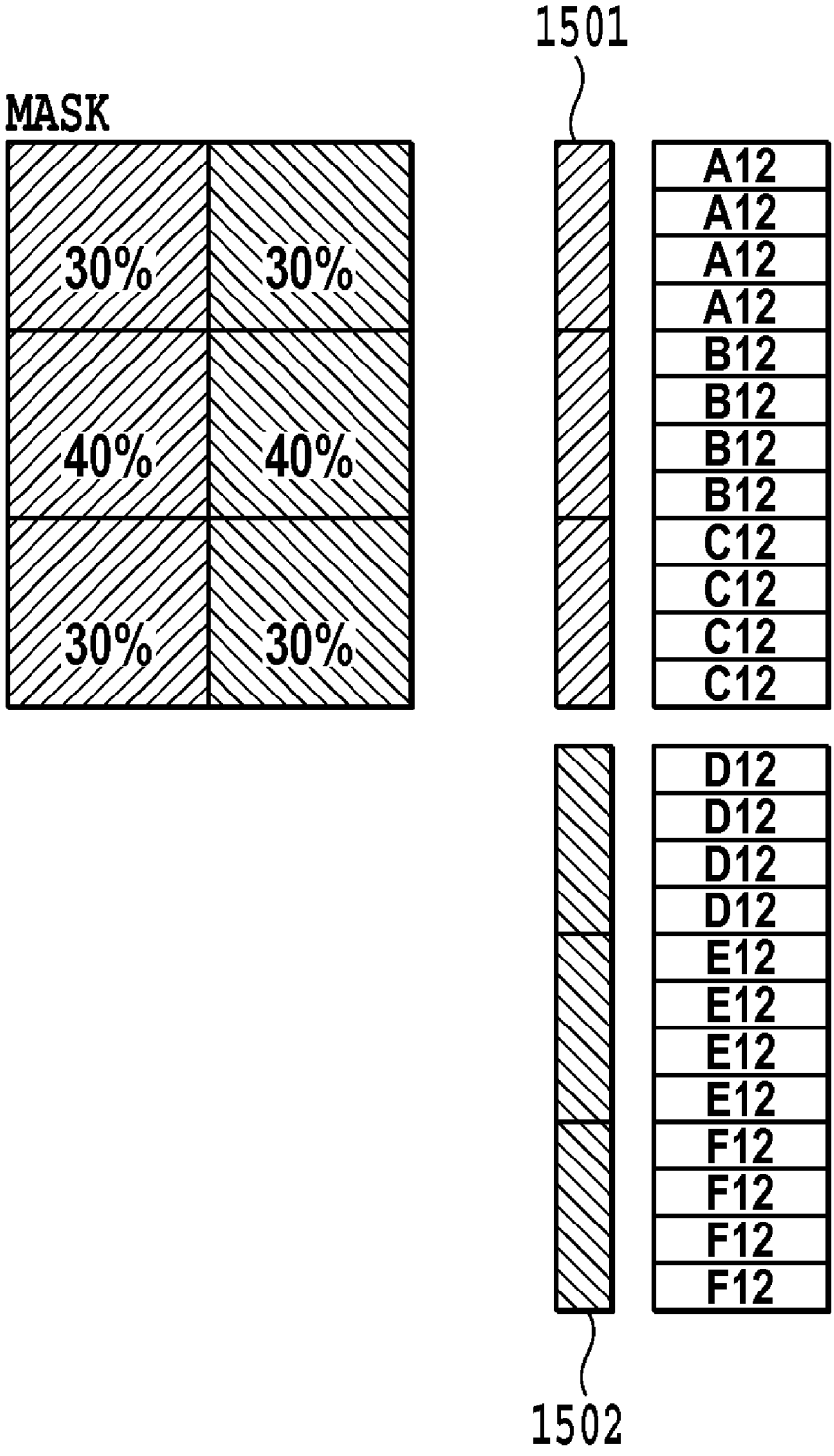
FIG. 20 is a schematic diagram showing a construction of a mask employed in the second embodiment, with a cyan nozzle array 1501 and a magenta nozzle array 1502 separated for explanation.

FIG. 20 is a schematic diagram showing a construction of a mask employed in this embodiment, with a cyan nozzle array 1501 and a magenta nozzle array 1502 shown separated for explanation. In this embodiment too, as in the first embodiment, each of these nozzle arrays are assumed to have 192 nozzles and are divided into three blocks A-C and D-F of 64 nozzles each. In this embodiment also, the three blocks are assigned mask patterns (A12-F12) each measuring 16 pixels in the nozzle alignment direction (sub-scan direction) and 32 pixels in the main scan direction.

Figure 21:
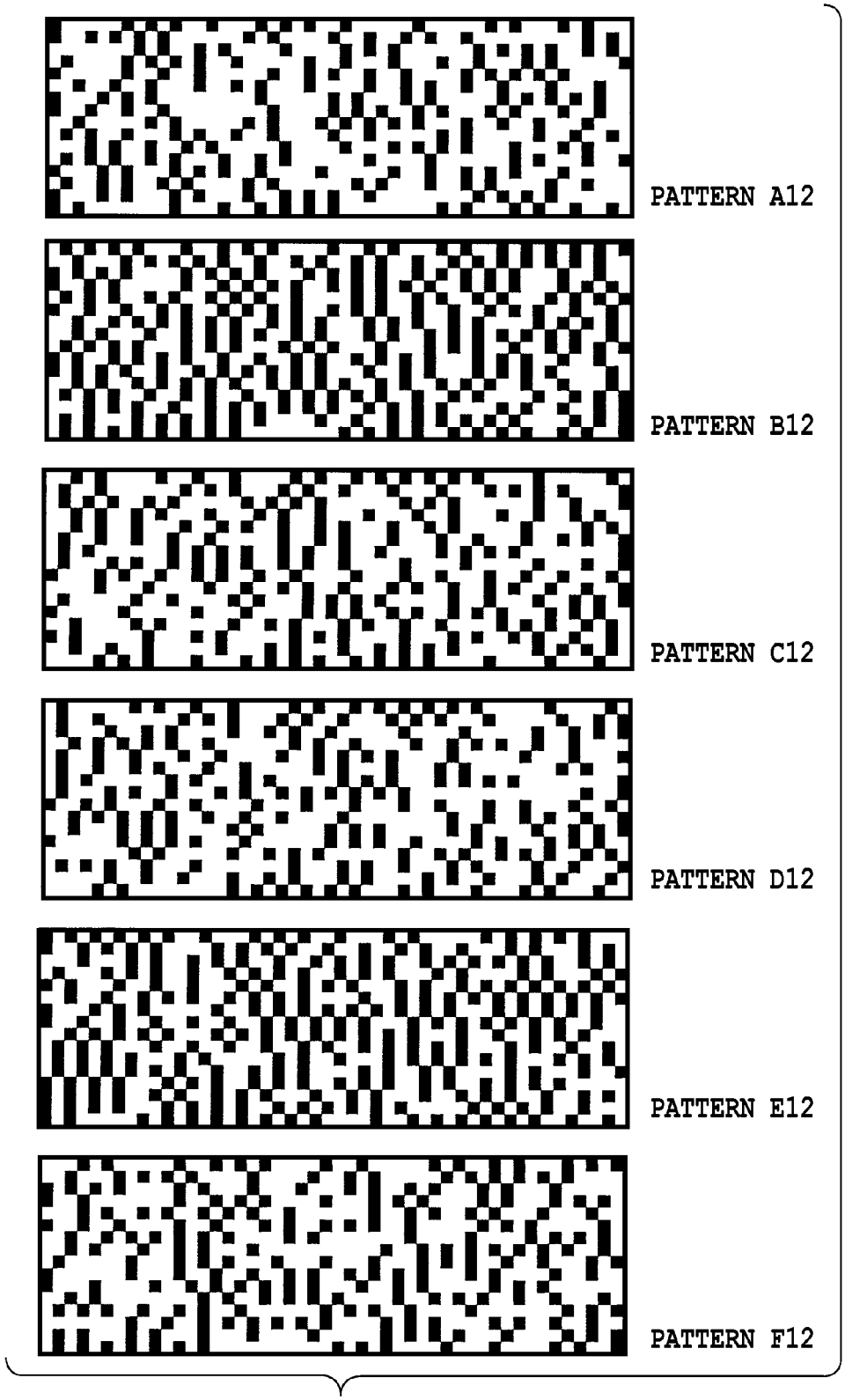
FIG. 21 shows mask patterns A12-F12 used in the second embodiment.
Figure 23:
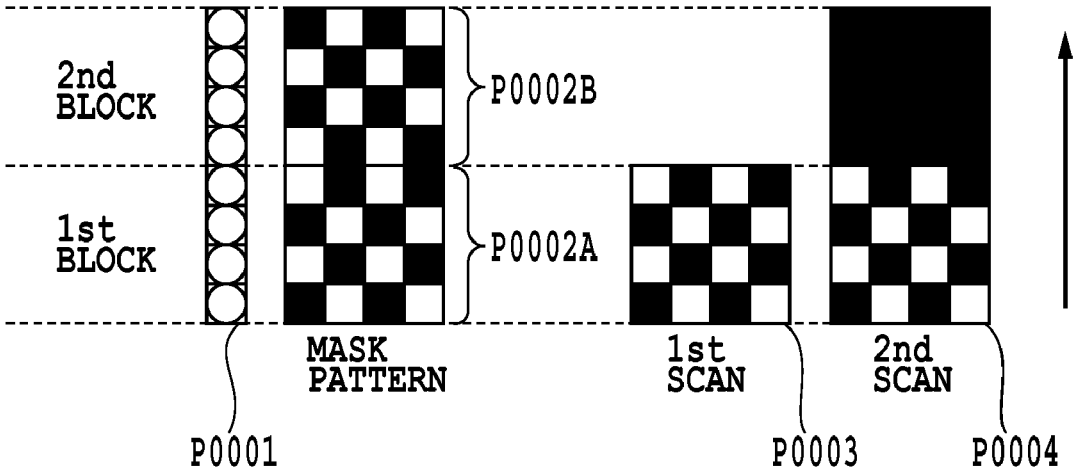
FIG. 23 is a diagram showing a mask pattern used in 2-pass printing.

FIG. 21 is a diagram showing mask patterns A12-F12 used in this embodiment. The mask pattern having the area measuring 16 pixels in the sub-scan direction by 32 pixels in the main scan direction is consist of print permitted pixels (black) and print non-permitted pixels (blank). As in the first embodiment, the three different mask patterns A12, B12, C12 are complementary to one another. Overlapping these mask patterns permits all pixels in the 16×32-pixel area to be printed once. The similar relationship holds also among the mask patterns D12, E12 and F12.

The mask of this embodiment is characterized by the following special relationship between the cyan mask patterns A12-C12 and the magenta mask patterns D12-F12.

(1) The mask pattern A and the mask pattern D are assigned a print permitted ratio of 30%.

(2) The mask pattern B and the mask pattern E are assigned a print permitted ratio of 40%.

(3) The mask pattern C and the mask pattern F are assigned a print permitted ratio of 30%.

(4) Most of print-permitted pixels of the mask pattern A12 are also print-permitted pixels of the mask pattern E12.

(5) Most of print-permitted pixels of the mask pattern F12 are also print-permitted pixels of the mask pattern B12.

(6) The mask pattern A12 and the mask pattern D12 have most of their print-permitted pixels held in an exclusion relationship.

(7) The mask pattern B12 and the mask pattern E12 have most of their print-permitted pixels held in an exclusion relationship.

(8) The mask pattern C12 and the mask pattern F12 have most of their print-permitted pixels held in an exclusion relationship.

(9) In all mask patterns the print-permitted pixels (black) are arranged so that they do not adjoin each other in the main scan direction.

In this embodiment, the condition (9) is added in order to avoid continuous ejection operations by the same print elements thereby practically reducing the drive frequency of individual print elements. While it adds the condition (9), this embodiment somewhat alleviates the conditions (4) to (8) compared to the first embodiment. That is, in the mask patterns of the second embodiment, the print-permitted pixels are arranged in a way that satisfies the conditions (4) to (8) as practically as possible while giving a top priority to the condition (9).

FIG. 22 shows overlapping factors among print-permitted-pixel of mask patterns of this embodiment that are prepared by the inventors of this invention so as to satisfy all of the above nine conditions. Referring to FIG. 22, let us examine the direction in which magenta dots are printed in cyan dot-printed pixels in this embodiment.

Figure 1C:
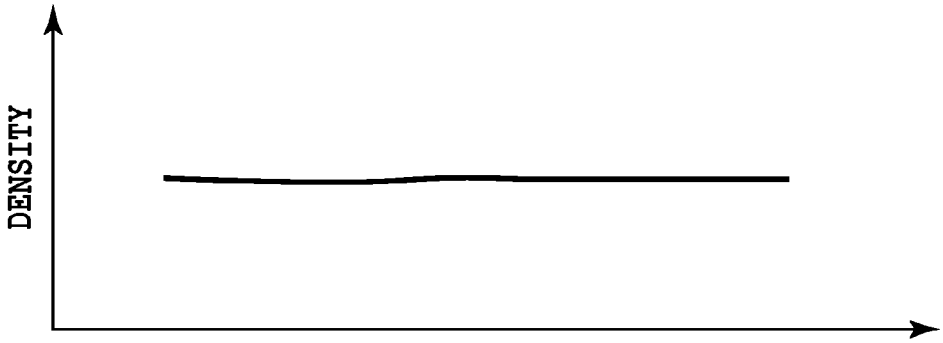
FIGS. 1A-1C are schematic diagrams showing a printing state of a print head with no ejection characteristic variations.
Figure 1B:
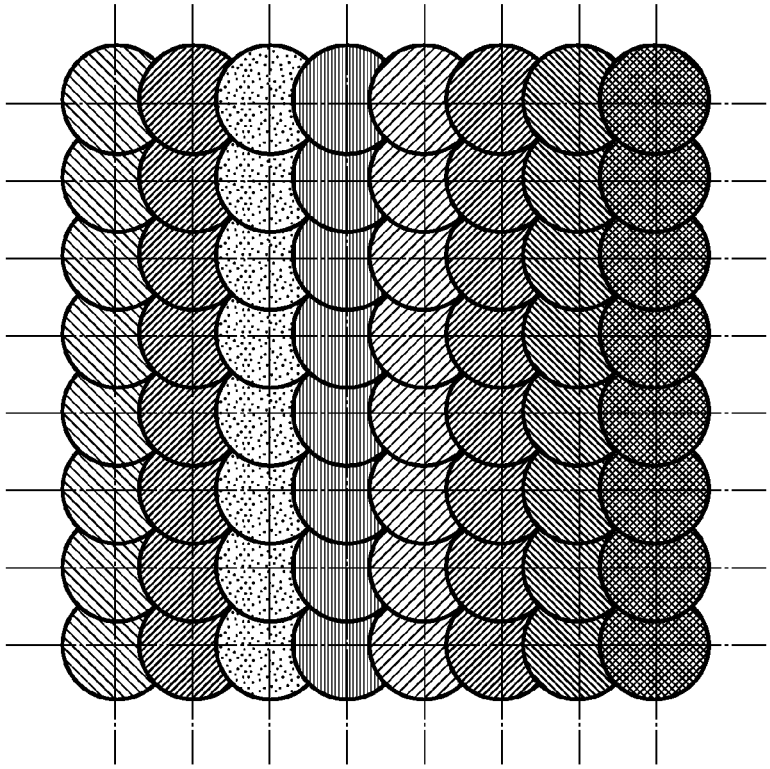
Figure 1A:
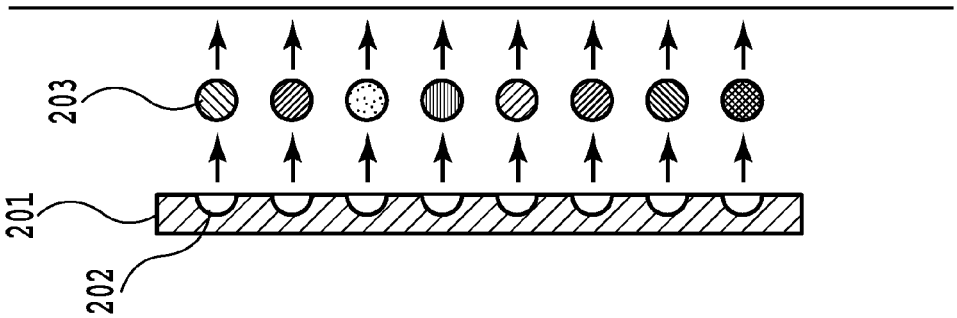
Figure 2C:
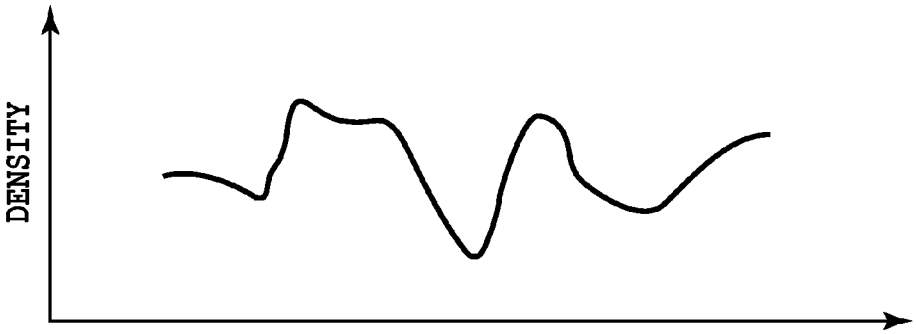
FIGS. 2A-2C are schematic diagrams showing a printing state of a print head with ejection characteristic variations.
Figure 2B:
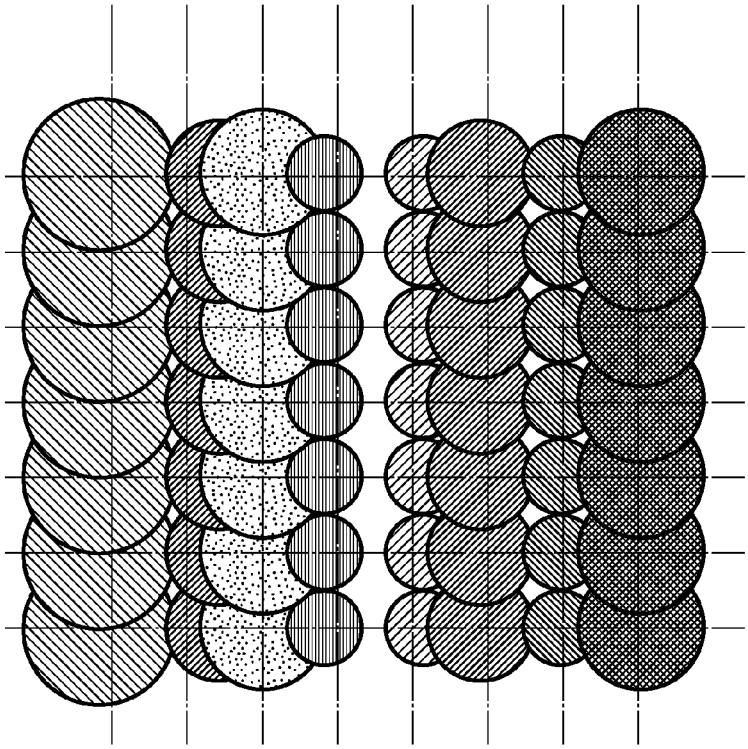
Figure 2A:
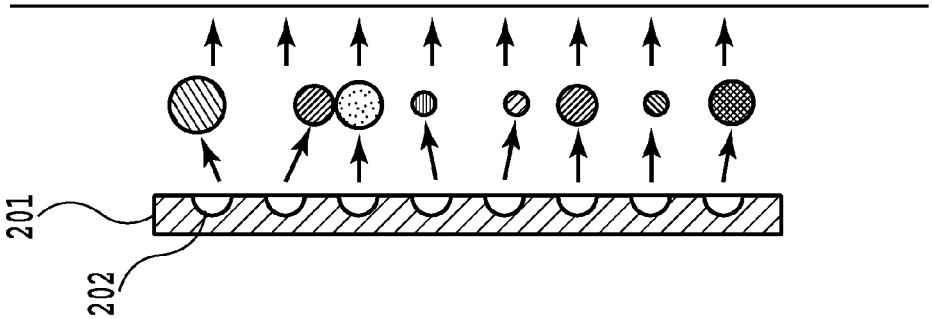
Figures 3A, 3B, 3C:
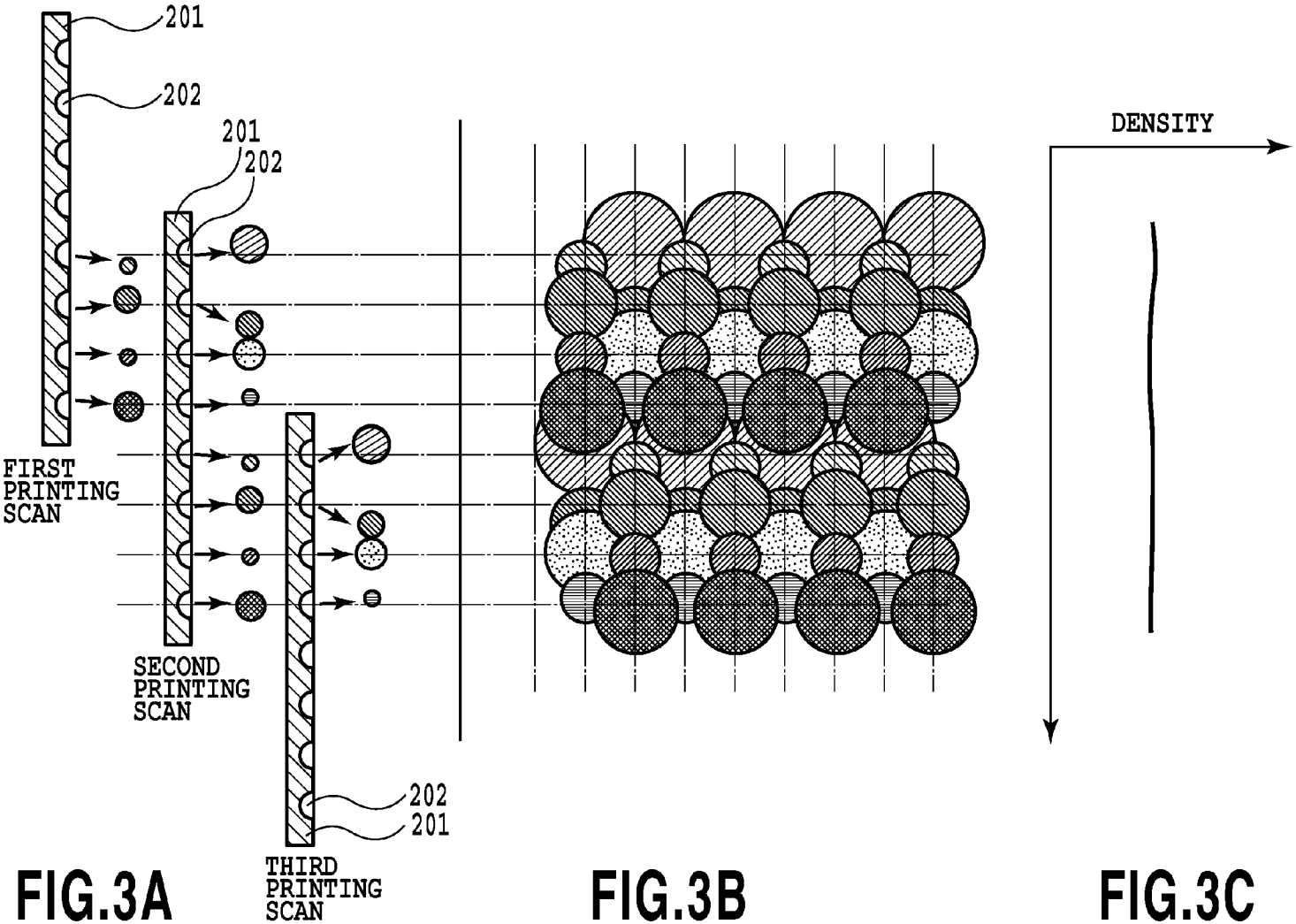
FIGS. 3A-3C are schematic diagrams showing a printing state when a multi-pass printing is performed using the print head of FIGS. 2A-2C.
Figure 4A:
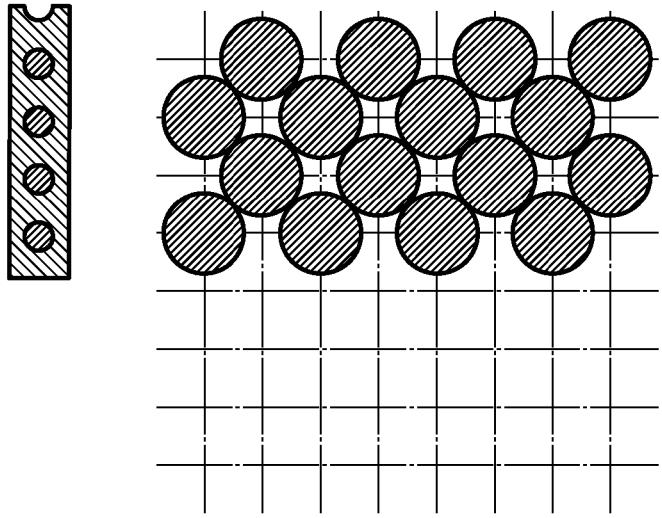
FIGS. 4A-4C are schematic diagrams showing an arrangement of dots printed by nozzles in three consecutive printing scans.
Figure 4B:
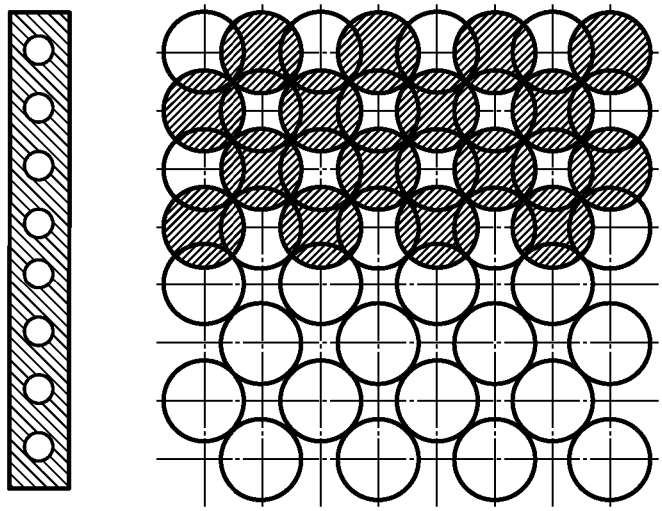
Figure 4C:
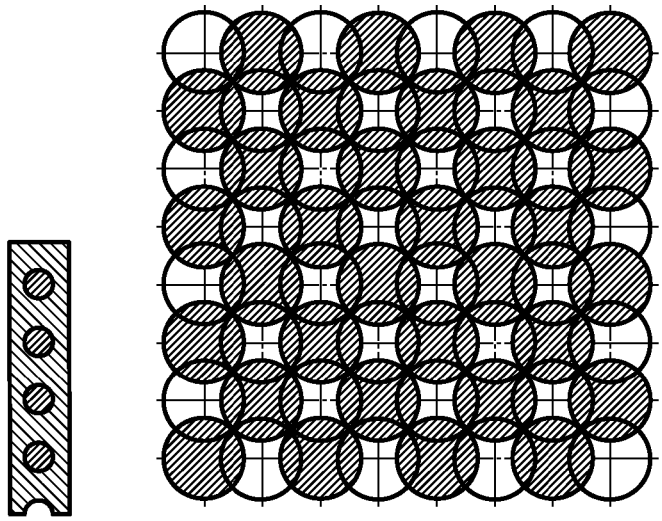
Figure 5B:
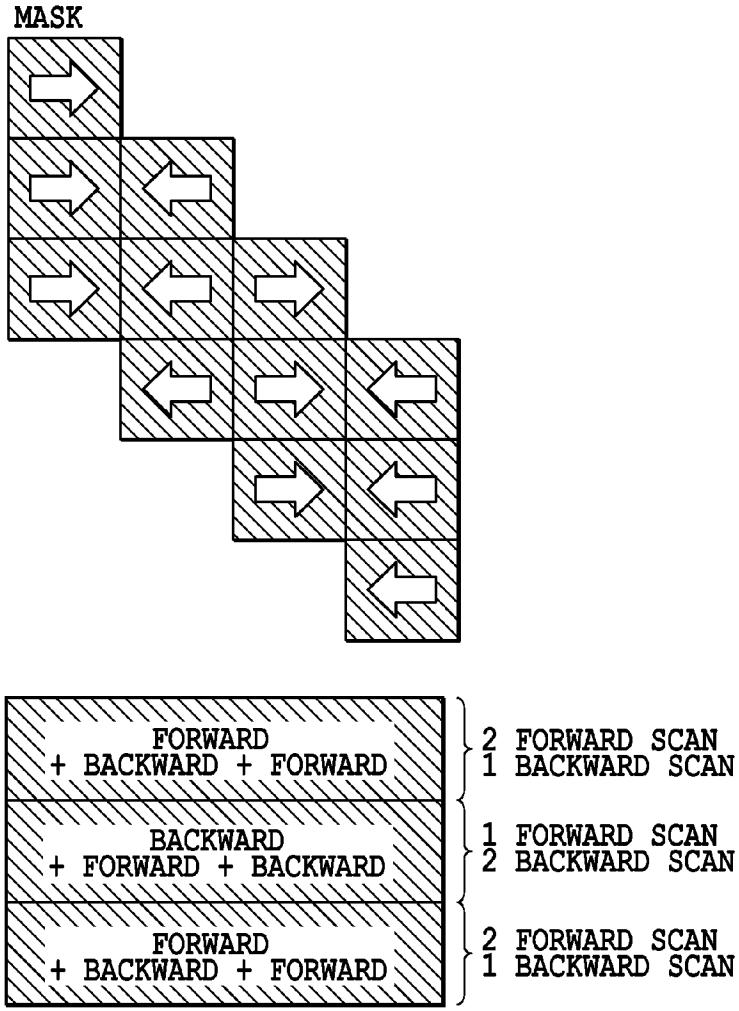
FIGS. 5A and 5B are schematic diagrams showing a difference between an even-numbered-pass printing (with four passes) and an odd-numbered-pass printing (with three passes)
Figure 5A:
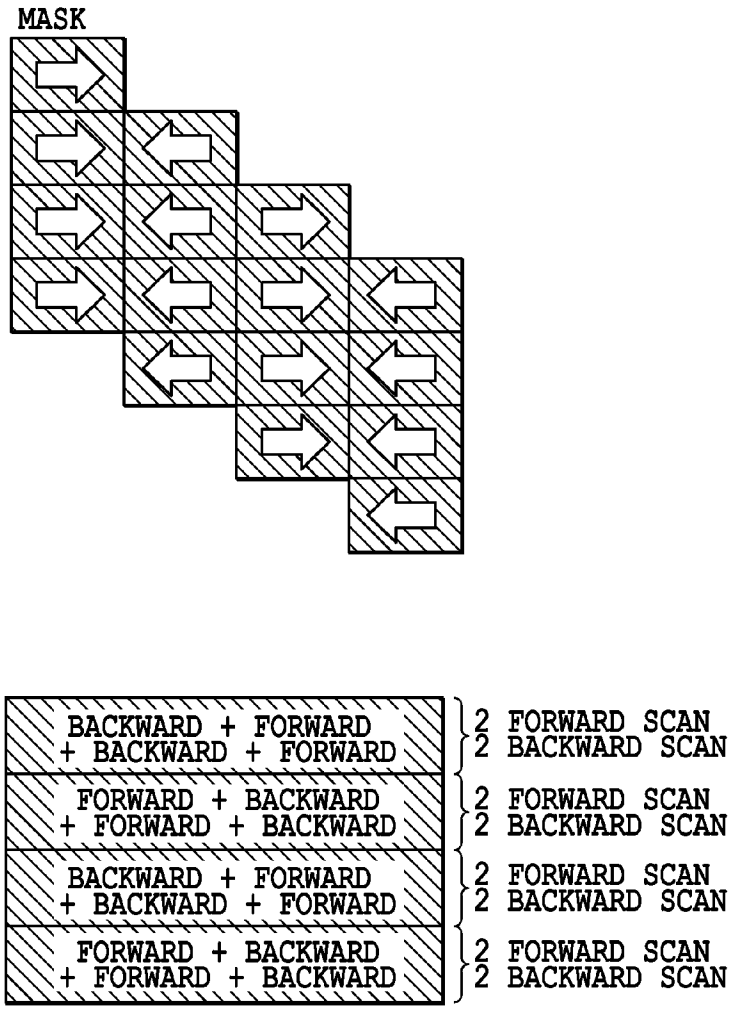
Figure 6:
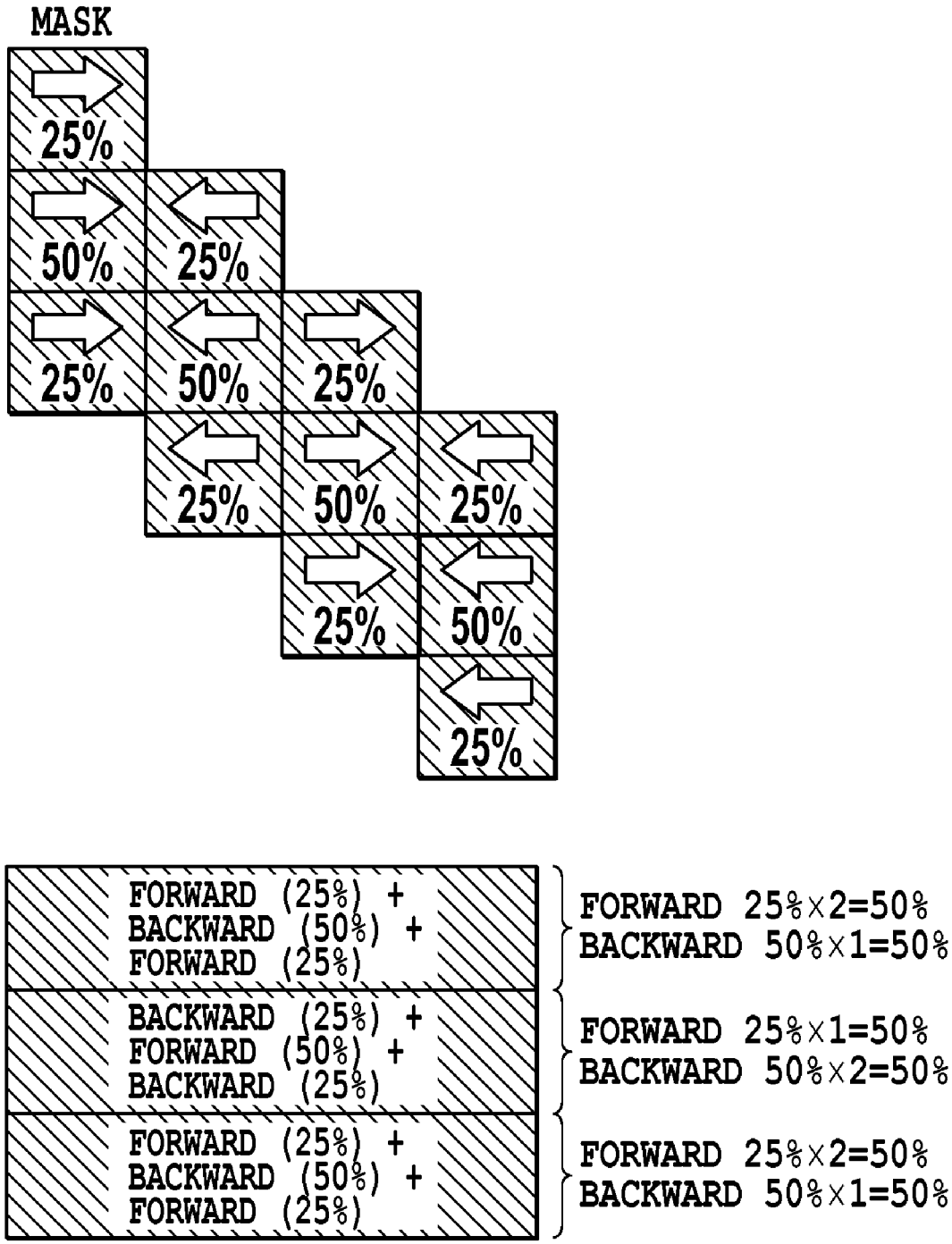
FIG. 6 is a schematic diagram showing print permitted ratios for forward scan and backward scan in a 3-pass printing.
Figure 7:
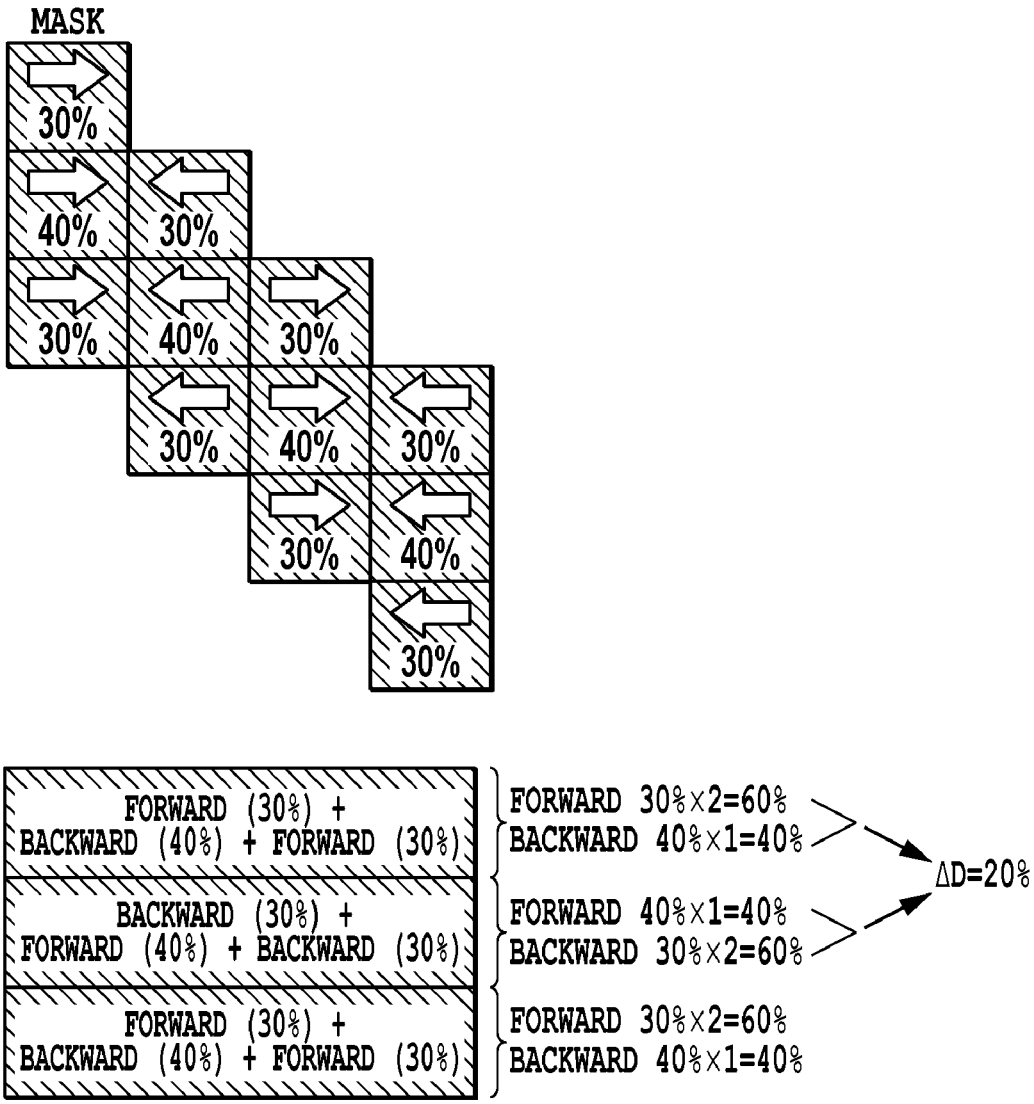
FIG. 7 is a schematic diagram showing an example case in which a nozzle array of a print head is divided into three blocks, of which both side blocks are given a print permitted ratio of 30% and a central block 40%.
Figure 8:
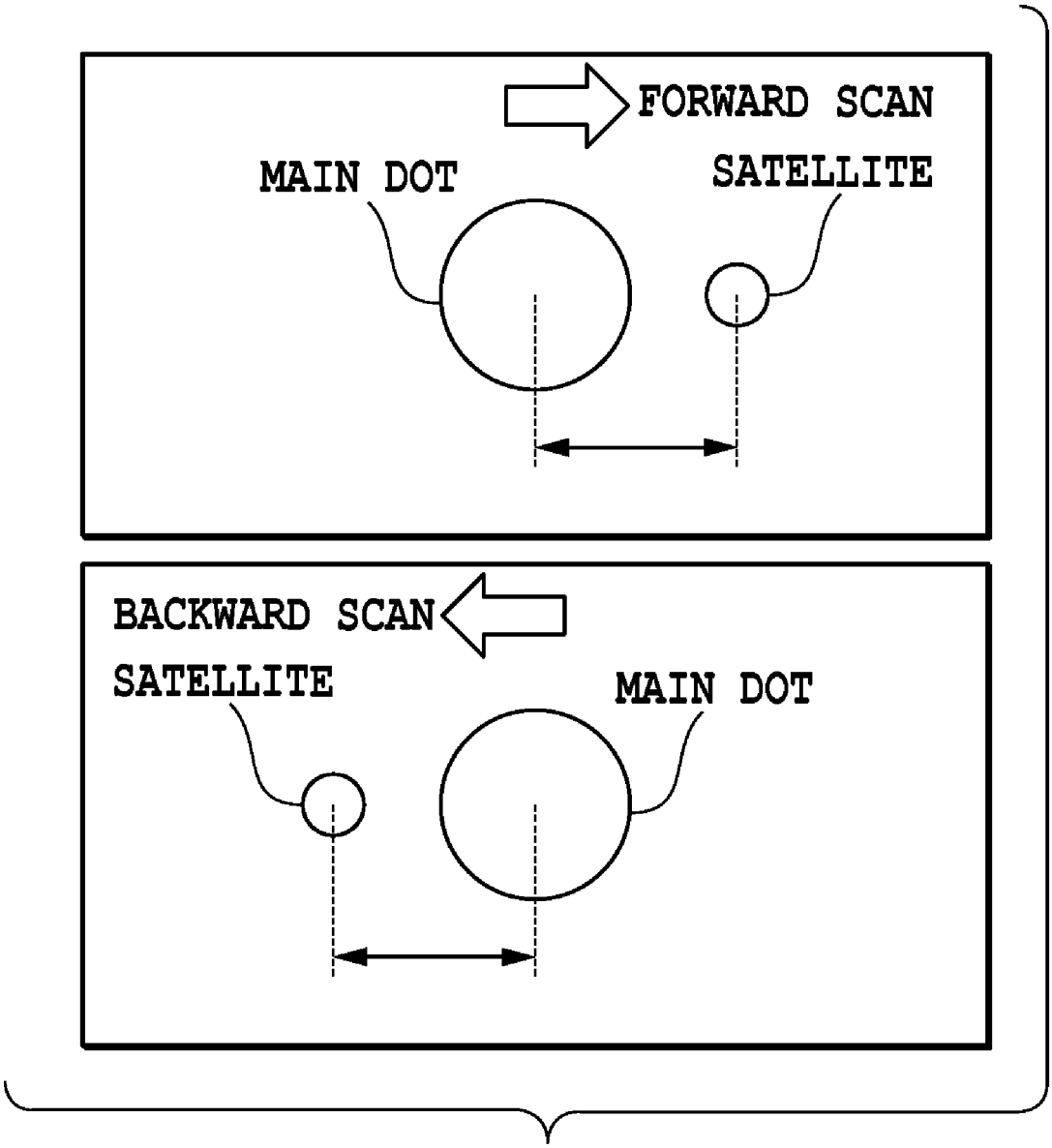
FIG. 8 is a schematic diagram showing a positional relation in a print medium between a main dot formed of a main droplet and a satellite.
Figure 9B:
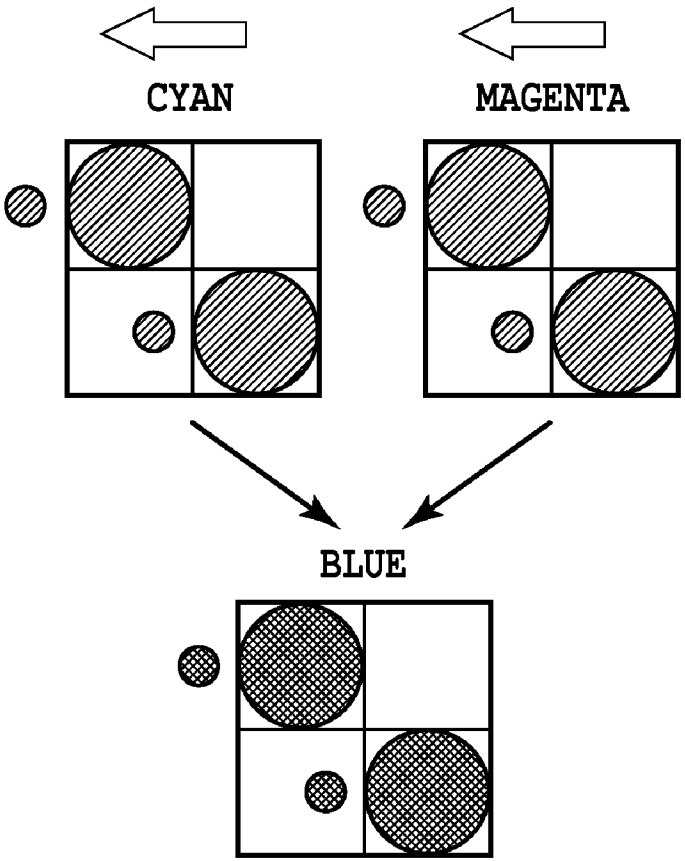
FIGS. 9A and 9B show how dots of cyan and magenta are overlapped to produce a blue color.
Figure 9A:
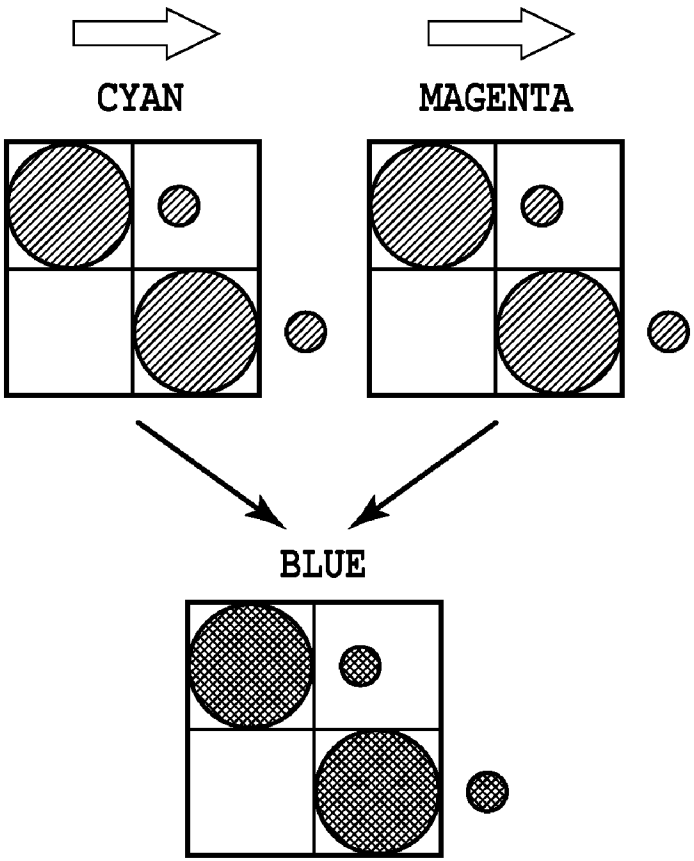
Figure 10:
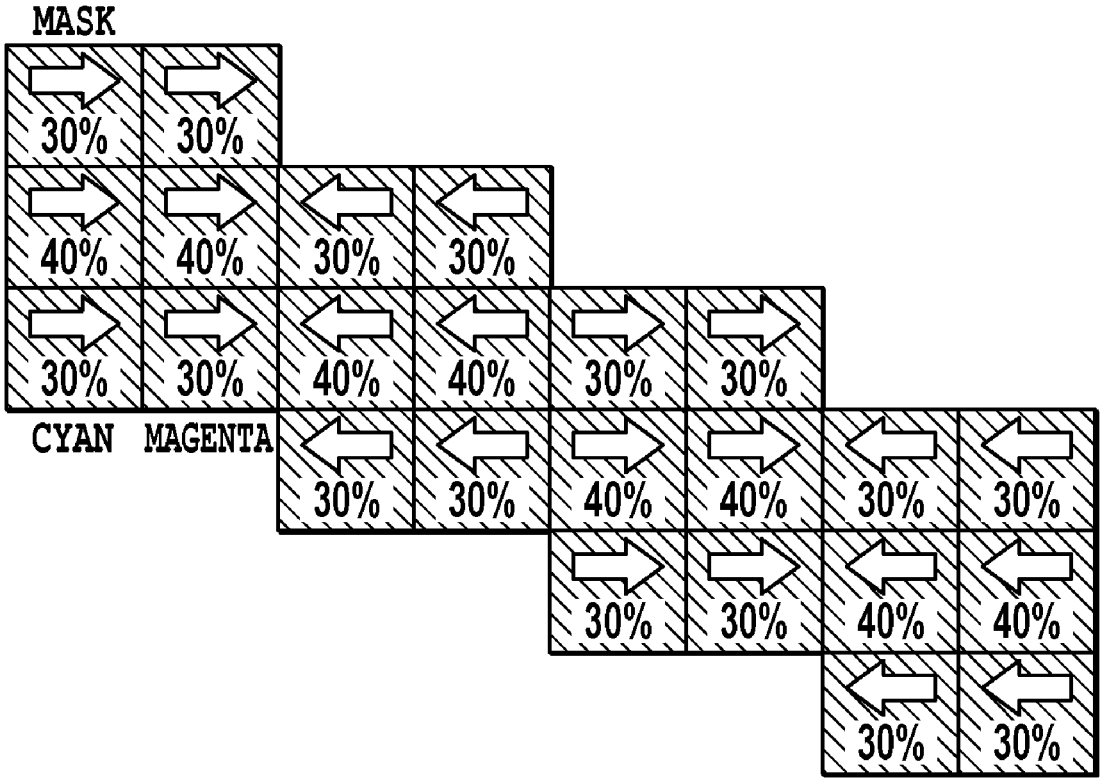
FIG. 10 is a schematic diagram showing an example case in which a nozzle array of a print head is divided into three blocks and in which a mask having a print permitted ratio of 30% for both side of blocks of the nozzle array and 40% for a central block is used both for cyan and magenta.

First, a percentage of cyan dots being printed by block A and magenta dots being printed by block E, namely an overlapping factor of pattern A12 and pattern E12, is 26.3%. A percentage of cyan dots being printed by block B and magenta dots being printed by block D, namely a sum of an overlapping factor of pattern B and pattern D and an overlapping factor of pattern B and pattern F, is 5.08%+31.25%=36.33%. Further, a percentage of cyan dots being printed by block C and magenta dots being printed by block E, namely an overlapping factor of pattern C12 and pattern E12, is 9.38%. Thus, the percentage (probability) of cyan dots and magenta dots being printed in the same pixels by opposite printing scans is 26.3%+36.33%+9.38%=72.02%. Therefore, the percentage (72.0%) of pixels in which cyan and magenta dots are printed by the printing scans in the opposite direction is much higher than 17.98%, the percentage of pixels in which cyan and magenta dots are printed by the printing scans in the same direction. Consequently, the percentage of pixels in which first color satellites are placed in both side of a second color main dot as shown in FIGS. 19A and 19B can be higher than the percentage of pixels in which second color satellite is placed in one side of a second color main dot as shown in FIGS. 9A and 9B. By this construction, it becomes possible to obtain a high quality image, reducing a bias of satellite positions and minimizing the appearance of the satellite itself.

As described above, this embodiment provides mask patterns for cyan nozzle array and mask patterns for magenta nozzle array in a way that satisfies the conditions (4) to (9) in addition to the conditions (1) to (3). Thus, a multi-pass printing with an odd number of scans is executed according to the mask patterns. By this construction, the percentage (probability) of cyan dots and magenta dots being printed by opposite printing scans can be set higher than that of cyan dots and magenta dots being printed by the same direction printing scans. In addition, regarding the stepping mask of this embodiment, a difference of the print permitted ratio between forward scans and backward scans is 20% which is smaller than 30% that is a difference of the print permitted ratio between forward scans and backward scans in a case of using a flat mask. As a result, image impairments caused by a difference of print permitted ratio between forward scans and backward scans and image impairments caused by bias of satellite positions can be effectively minimized while at the same time the drive frequency of individual nozzles can also be practically reduced.

Other Embodiment

While in the preceding embodiments the printing apparatus 200 has been described to be connected to the information processing device 100, that the user directly accesses, to form a printing system, the present invention is not limited to this configuration. They may be configured so that the user can directly access the printing apparatus to set a print mode. In this case, the user select one print mode to be performed from a plurality print mode using an operation panel and the selected print mode is set in the printing apparatus 200. The mask patterns used in the preceding embodiments, while they may be stored in the memory (ROM 211) of printing apparatus 200, may also be stored in a memory of the information processing device 100. In that case, mask patterns corresponding to the print modes need only to be transferred along with image data to the printing apparatus, or image data processed by the mask patterns needs to be transferred to the printing apparatus as print signals for individual printing scans.

Additionally, while in the preceding embodiments two types of inks of cyan and magenta are used for example, two types of inks acceptable to the present invention are not limited to cyan and magenta. For example, two types of inks of yellow and magenta are acceptable to the mask patterns described above. Furthermore, while in the preceding embodiments distributions of print permitted ratios of two types of mask patterns corresponding to two inks (cyan and magenta) are same, the distributions of print permitted ratios may different between two inks. For example, the print permitted ratio for one type ink (e.g. cyan) can be set to 30%, 40% and 30% for first pass, second pass and third pass with setting the print permitted ratio for the other type ink (e.g. magenta) to 18%, 44% and 28%. It is necessary, however, that print permitted pixels of the two type mask patterns are arranged such a way that a percentage of pixels in which two inks are permitted to be printed in a opposite direction movement is higher than that of pixels in which two inks are permitted to be printed in a same direction movement.

While in the above embodiments, a stepping mask in which a difference in print permitted ratio between forward scans and backward scans is smaller than 100/M % (M is an odd number equal to 3 or more) is used for a M-pass print mode. The present invention is not limited to this configuration. For reducing image impairment caused by a biased position of satellites, it is effective to set a print permitted ratio of pixels in which predetermined two types of inks are printed by scans in opposite direction higher than that of pixels in which the predetermined two types of inks are printed by scans in same direction. Therefore, if a mask pattern meting this condition is used, the first object of the present invention is accomplished. So it is not necessary to use a stepping mask in which a difference in print permitted ratio between forward scans and backward scans is lower than 100/M %. It is favorable, however, to use a stepping mask in which a difference in print permitted ratio between forward scans and backward scans is lower than 100/M % in order to solve both the problem of image impairments caused by a difference in print permitted ratio between forward scans and backward scans and the problem of image impairments caused by a biased position of satellites. The difference in print permitted ratio between forward scans and backward scans means to a difference between a percentage of pixels permitted to be printed in forward scans and a percentage of pixels permitted to be printed in backward scans.

Additionally, while in the first and second embodiments the 3-pass print mode is explained as an example for M-pass print mode (M is an odd number equal to 3 or more), it is not limited to this construction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-211474, filed Aug. 14, 2007, which is hereby incorporated by reference herein in its entirety.

What is claimed is:

1. An ink jet printing apparatus capable of performing a bidirectional printing for printing an image on a print medium by a print head capable of ejecting at least two types of inks during forward and backward movements of the print head, said apparatus comprising:

means for executing the bidirectional printing according to two types of mask patterns corresponding to the two types of inks by M (M is an odd number equal to 3 or more) times movements of the print head, between which the print medium is conveyed by a distance smaller than a length of the print head, wherein print permitted pixels and print non-permitted pixels of the two types of mask patterns are arranged in such a way that a percentage of pixels permitted to be printed with two types of inks by the movements of different directions is higher than a percentage of pixels permitted to be printed with the two types of inks by the movements of the same direction.

2. An ink jet printing apparatus according to claim 1, wherein print permitted pixels of the two types of mask patterns are arranged respectively in such a way that a difference in print permitted ratio between the forward movements and backward movements is lower than 100/M %.

3. An ink jet printing apparatus according to claim 2, wherein the M is equal to 3.

4. An ink jet printing apparatus according to claim 1, wherein the two types of inks have different colors.

5. An ink jet printing apparatus according to claim 4, wherein the two types of inks are cyan ink and magenta ink.

6. An ink jet printing apparatus according to claim 1, wherein in the two types of mask patterns, the print-permitted pixels do not adjoin in a direction of the movement.

7. An ink jet printing apparatus capable of performing a bidirectional printing for printing an image on a same image area of a print medium by a print head for ejecting at least two types of inks during forward and backward movements of the print head, said apparatus comprising:

a mask pattern for dividing an image data corresponding to the same image area into image data corresponding to M (M is a odd number equal to 3 or more) times movements, the mask pattern consisting of arrangement of print permitted pixels and print non-permitted pixels; and means for executing the bidirectional printing to the same image area according to the image data divided by said mask pattern;

wherein print permitted pixels and print non-permitted pixels of said mask pattern are arranged in such a way that a percentage of pixels permitted to be printed with the two types of inks by the movements of different directions is higher than a percentage of pixels permitted to be printed with the two types of inks by the movements of the same direction.

8. A printing system including an ink jet printing apparatus and a control apparatus for controlling the ink jet printing apparatus, the ink jet printing apparatus being capable of performing a bidirectional printing for printing an image on a same image area of a print medium by a print head for ejecting at least two types of inks during forward and backward movements of the print head, said printing system comprising:

means for executing the bidirectional printing to the same image area according to two types of mask patterns corresponding to the two types of inks by M (M is an odd number equal to 3 or more) times movements of the print head, between which the print medium is conveyed by a distance smaller than a length of the print head, wherein print permitted pixels and print non-permitted pixels of the two types of mask patterns are arranged in such a way that a percentage of pixels capable of being printed with two types of inks by the movements of different directions is higher than a percentage of pixels not capable of being printed with the two types of inks by the movements of the same direction.

9. An ink jet printing method capable of performing a bidirectional printing for printing an image on a same image area of a print medium by a print head for ejecting at least two types of inks during forward and backward movements of the print head, said method comprising the steps of:

dividing an image data corresponding to the same image area into image data corresponding to M (M is a odd number equal to 3 or more) times movements according to a mask pattern consisting of arrangement of print permitted pixels and print non-permitted pixels; and executing the bidirectional printing to the same image area by the M times movements according to the image data divided by said dividing step, wherein print permitted pixels and print non-permitted pixels of the mask pattern are arranged in such a way that a percentage of pixels permitted to be printed with the two types of inks by the movements of different directions is higher than a percentage of pixels permitted to be printed with the two types of inks by the movements of the same direction.

* * * * *